US008899855B2

(12) United States Patent
Taki et al.

(10) Patent No.: US 8,899,855 B2
(45) Date of Patent: Dec. 2, 2014

(54) ERASING APPARATUS AND CONVEYANCE CONTROL METHOD FOR RECORDING MEDIUM

(75) Inventors: Hiroyuki Taki, Shizuoka-ken (JP); Ken Iguchi, Shizuoka-ken (JP); Isao Yahata, Shizuoka-ken (JP); Takahiro Kawaguchi, Shizuoka-ken (JP); Hiroyuki Taguchi, Shizuoka-ken (JP); Hiroyuki Tsuchihashi, Shizuoka-ken (JP); Yoshiaki Sugizaki, Shizuoka-ken (JP); Kikuo Mizutani, Shizuoka-ken (JP); Chiaki Iizuka, Shizuoka-ken (JP); Hidetoshi Yokochi, Shizuoka-ken (JP); Toshiaki Oshiro, Shizuoka-ken (JP); Hiroyuki Hazu, Shizuoka-ken (JP); Yoici Yamaguchi, Shizuoka-ken (JP); Hiroyuki Sugiyama, Shizuoka-ken (JP); Yuichi Saito, Shizuoka-ken (JP); Jun Ishii, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/310,533

(22) Filed: Dec. 2, 2011

(65) Prior Publication Data

US 2012/0148327 A1 Jun. 14, 2012

Related U.S. Application Data

(60) Provisional application No. 61/421,606, filed on Dec. 9, 2010, provisional application No. 61/421,608, filed on Dec. 9, 2010, provisional application No. 61/540,478, filed on Sep. 28, 2011.

(30) Foreign Application Priority Data

Nov. 15, 2011 (JP) ..... P2011-249277
Nov. 16, 2011 (JP) ..... P2011-250210

(51) Int. Cl.
*B41J 11/60* (2006.01)
*B41J 29/38* (2006.01)

(Continued)

(52) U.S. Cl.
CPC ..... *B41J 11/006* (2013.01); *B41J 29/38* (2013.01); *B41J 2/32* (2013.01);

(Continued)

(58) Field of Classification Search
CPC .... B41J 11/60; B41J 29/16; B41J 2002/4756; B41J 2002/4753; B41J 2002/37; B41M 2205/18
USPC ..... 399/18–21, 122, 124, 320, 68, 374; 430/10, 19; 400/695, 696, 698, 700
See application file for complete search history.

(56) References Cited

U.S. PATENT DOCUMENTS 5,405,726 A * 4/1995 Abe et al. ..... 430/97

(Continued)

FOREIGN PATENT DOCUMENTS

JP 04-174485 6/1992

(Continued)

OTHER PUBLICATIONS

Office Action dated Feb. 5, 2015, filed in corresponding Japanese Patent Application No. 2011-250210, with English Translation.

(Continued)

*Primary Examiner* — Matthew G Marini
(74) *Attorney, Agent, or Firm* — Patterson & Sheridan LLP

(57) ABSTRACT

According to one embodiment, a erasing apparatus includes: a paper feeding section configured to feed a recording medium on which a erasable image is recorded to a conveying path; a conveying section configured to convey the recording medium along the conveying path; a erasing section configured to erase a color of the image on the recording medium; a sensor configured to detect the recording medium conveyed through the erasing section by the conveying section; and a control section configured to perform, if the sensor detects occurrence of a jam of the recording medium, control to convey the recording medium present in the conveying path.

21 Claims, 22 Drawing Sheets

(51) Int. Cl.
*B41J 11/00* (2006.01)
*B41J 2/32* (2006.01)
*B41J 29/26* (2006.01)

(52) U.S. Cl.
CPC ..... *B41J 2202/37* (2013.01); *B41J 29/26* (2013.01)
USPC ..... 400/695; 400/696

(56) References Cited

U.S. PATENT DOCUMENTS

| | | | | |
|---|---|---|---|---|
| 5,502,545 | A | 3/1996 | Tsuruoka | |
| 5,572,311 | A * | 11/1996 | Abe et al. | 399/127 |
| 6,754,458 | B2 * | 6/2004 | Makihira | 399/92 |
| 7,239,818 | B2 * | 7/2007 | Matsuura et al. | 399/45 |
| 7,480,466 | B2 * | 1/2009 | Uchida | 399/21 |
| 2002/0131802 | A1 * | 9/2002 | Shimizu et al. | 399/405 |
| 2008/0095546 | A1 * | 4/2008 | Abe | 399/21 |
| 2010/0118361 | A1 | 5/2010 | Iguchi | |
| 2010/0194020 | A1 | 8/2010 | Iguchi | |
| 2010/0196063 | A1 * | 8/2010 | Iguchi et al. | 399/322 |

FOREIGN PATENT DOCUMENTS

| | | |
|---|---|---|
| JP | H09-114156 | 5/1997 |
| JP | H10-307495 | 11/1998 |
| JP | 2000-075703 | 3/2000 |
| JP | 2000-305425 | 11/2000 |
| JP | 2000-352890 | 12/2000 |
| JP | 2002-287586 | 10/2002 |
| JP | 2002-347262 | 12/2002 |
| JP | 2007-101810 | 4/2007 |
| JP | 2009-042402 | 2/2009 |
| JP | 2010-113337 | 5/2010 |

OTHER PUBLICATIONS

Office Action dated Feb. 5, 2015, filed in corresponding Japanese Patent Application No. 2011-249277, with English Translation.
English translation of Office Action dated May 8, 2014, filed in corresponding Japanese Patent Application No. 2011-249277.

* cited by examiner

ERASING APPARATUS AND CONVEYANCE CONTROL METHOD FOR RECORDING MEDIUM

CROSS-REFERENCE TO RELATED APPLICATIONS

This application is based upon and claims the benefit of priority from the prior U.S. Patent Applications No. 61/421,606, 61/421,608, filed on Dec. 9, 2010, 61/540,478, filed on Sep. 28, 2011, the entire contents all of which are incorporated herein by reference.

This application is also based upon and claims the benefit of priority from the prior Japanese Patent Applications No. 2011-249277, filed on Nov. 15, 2011, No. 2011-250210, filed on Nov. 16, 2011, the entire contents all of which are incorporated herein by reference.

FIELD

Embodiments described herein relate generally to a erasing apparatus and a conveyance control method for a recording medium by the erasing apparatus.

BACKGROUND

In the past, there is known a erasing apparatus that applies, with high-temperature heat, erasing processing to a sheet subjected to image formation by an image forming apparatus and erases an image. However, if the erasing apparatus is stopped in a state in which the sheet remains in a erasing section because of a sheet jam or the like during the erasing processing, the sheet is burned because the erasing section is hot.

DETAILED DESCRIPTION

Figure 1:
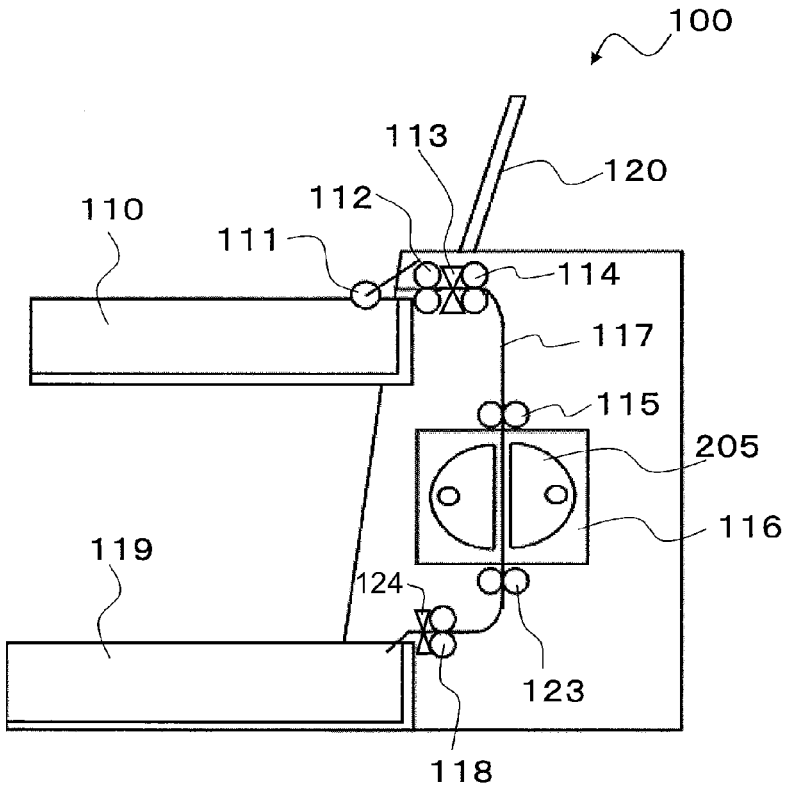
FIG. 1 is a configuration diagram of a erasing apparatus in a first embodiment.

In general, according to one embodiment, there is provided a erasing apparatus including: a paper feeding section configured to feed a recording medium on which a erasable image is recorded to a conveying path; a conveying section configured to convey the recording medium along the conveying path; a erasing section configured to erase a color of the image on the recording medium; a sensor configured to detect the recording medium conveyed through the erasing section by the conveying section; and a control section configured to perform, if the sensor detects occurrence of a jam of the recording medium, control to convey the recording medium present in the conveying path.

Embodiments will now be described in more detail with reference to the accompanying drawings. However, the same numerals are applied to the similar elements in the drawings, and therefore, the detailed descriptions thereof are not repeated.

First Embodiment

A deploring apparatus according to a first embodiment moves a sheet in a erasing section from the erasing section if the erasing apparatus has to be stopped in a state in which the sheet is present in the erasing section.

FIG. 1 is a configuration diagram of a erasing apparatus 100. The erasing apparatus 100 erases an image on a sheet (a recording medium) formed with a erasable color material by an image forming apparatus and enables reuse of the sheet. The color material is, for example, metamorphic ink. The erasing apparatus 100 includes a paper feeding section 110, a pickup roller 111, a separation roller 112, a double-feed detection sensor 113, a registration roller 114, conveying rollers 115 and 123, a erasing section 116, a conveying path 117, a discharge roller 118, a paper discharge section 119, a control panel 120, and a sheet detection sensor 124. The pickup roller 111, the separation roller 112, the registration roller 114, the conveying rollers 115 and 123, and the discharge roller 118 form a conveying section.

The paper feeding section 110 is provided in an upper part on a side of the erasing apparatus 100. Sheets P to be reused are stacked on the paper feeding section 110. The paper feeding section 110 feeds the sheets P to the inside of the erasing apparatus 100 in order to erase images on the sheets P. The pickup roller 111 picks up the sheets P from the paper feeding section 110 one by one and delivers the sheet P to the conveying path 117.

The separation roller 112 is formed by a pair of rollers. The separation roller 112 rotates one roller and stops the rotation of the other roller. The separation roller 112 rotates one roller and prevents double feed of the sheets P to convey the sheets P one by one.

The double-feed detection sensor 113 detects double feed of the sheets P conveyed from the paper feeding section 110. The double-feed detection sensor 113 is, for example, an ultrasonic sensor or an optical sensor. The double-feed detection sensor 113 plays a role of a sheet detection sensor as well and detects the sheet P.

The registration roller 114 is formed by a pair of rollers and corrects a tilt of the sheet P. The registration roller 114 performs the tilt correction for the sheet P by striking the leading end of the sheet P against a portion where the pair of rollers of the stopped registration roller 114 are in contact with each other. The conveying roller 115 is formed by a pair of rollers. The conveying roller 115 conveys the sheet P, which is delivered to the conveying path according to the rotation of the registration roller 114, to the erasing section 116.

The erasing section 116 includes a pair of heaters 205 (heating sources) opposed to each other via the conveying path 117. The erasing section 116 causes the sheet P to pass through the conveying path between the heaters 205 to thereby apply heat of fixed or higher temperature to the sheet P, heat an image on the sheet P formed using a erasable color material, and make the color material colorless. The erasing section 116 performs image erasing with the pair of heaters 205 to thereby enable simultaneous erasing of images formed on both sides of the sheet P. The paper discharge section 119 is arranged in a lower part on the side of the erasing apparatus 100. The sheet P subjected to erasing processing is discharged to the paper discharge section 119. The sheet detection sensor 124 detects the sheet P.

Figure 3:
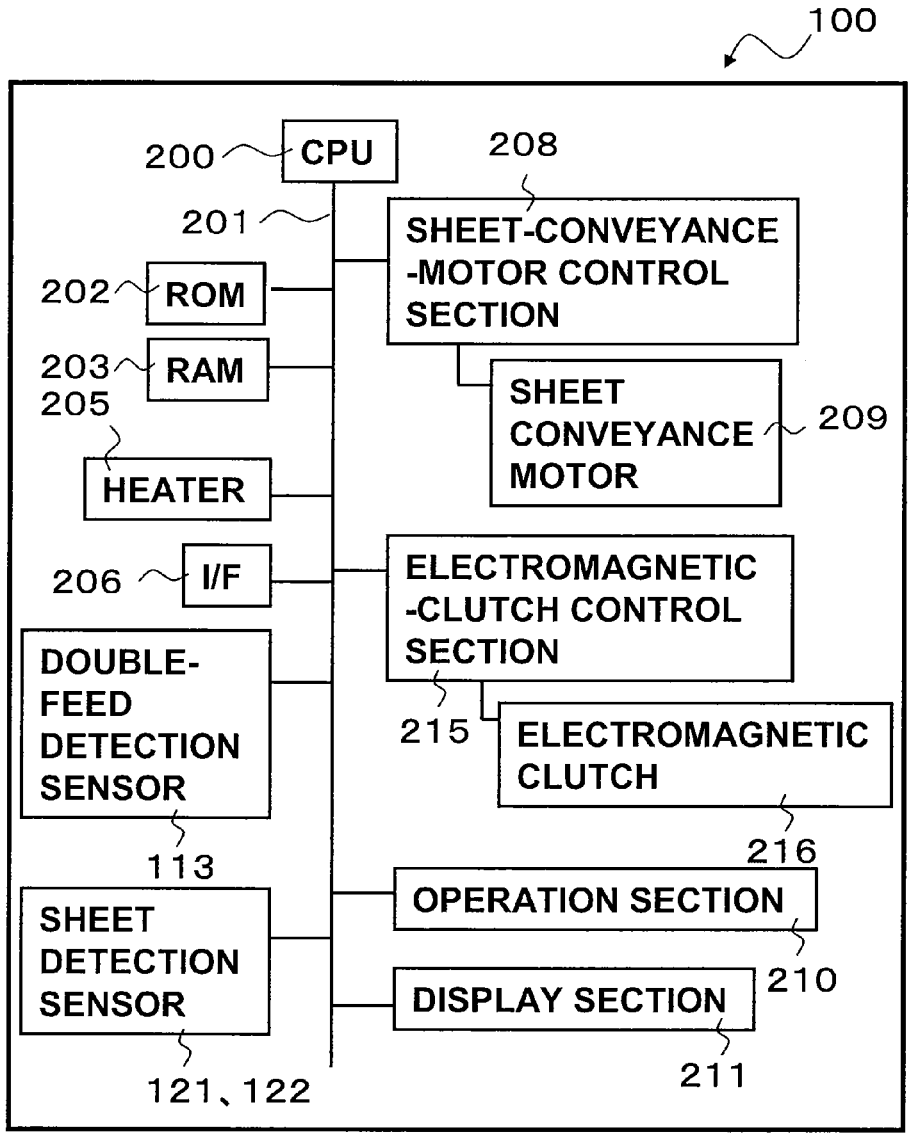
FIG. 3 is a block diagram of the erasing apparatus in the first embodiment.

The control panel 120 includes an operation section 210 and a display section 211 shown in FIG. 3. The operation section 210 includes various keys. The display section 211 may also functions as an operation section of a touch panel type.

Figure 2:
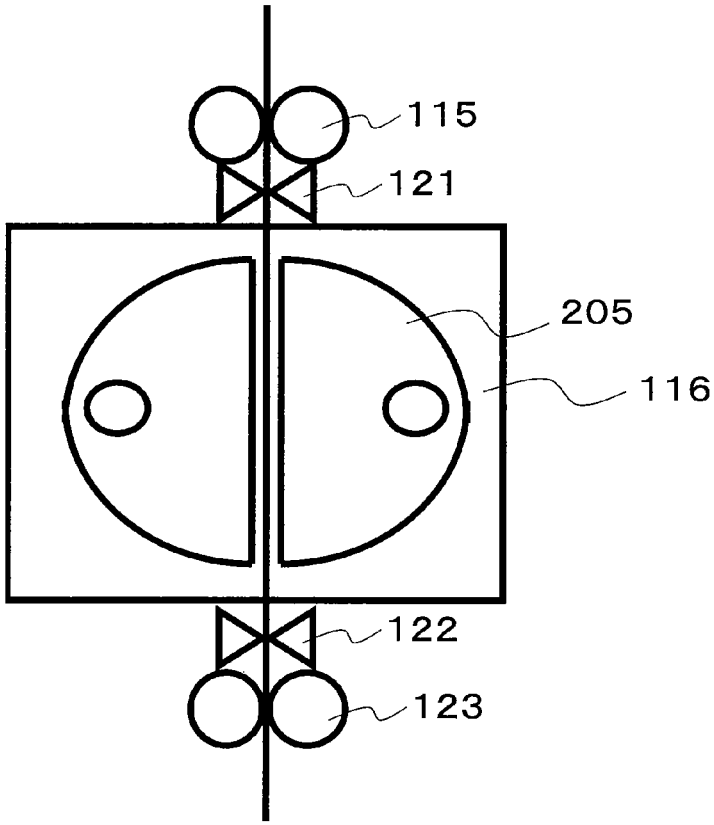
FIG. 2 is an enlarged view of a erasing section in the first embodiment.

FIG. 2 is an enlarged view of the erasing section 116. A first sheet detection sensor 121 and the conveying roller 115 are located along the conveying path 117 from the erasing section 116 toward upstream in a conveying direction of the sheet P. A second sheet detection sensor 122 and the conveying roller 123 are located along the conveying path 117 from the erasing section 116 toward downstream in the conveying direction. The first and second sheet detection sensors 121 and 122 detect the sheet P respectively in an inlet and an outlet of the erasing section 116. If the second sheet detection sensor 122 does not detect the sheet P within a predetermined number of pulses or a predetermined time after the first sheet detection sensor 121 detects the sheet P, it is determined that a sheet jam occurs in the erasing section 116. If occurrence of a jam is determined according to the number of pulses, it is determined that a sheet jam occurs, for example, if the second sheet detection sensor 122 does not detect the sheet P when 115 pulses elapse after the first sheet detection sensor 121 detects the sheet P.

Determination of occurrence of a jam in the sheet detection sensor 124 and the double-feed detection sensor 113 is performed in the same manner as in the first sheet detection sensor 121 and the second sheet detection sensor 122. If occurrence of a jam is not detected within the predetermined number of pulses or the predetermined time or if occurrence of a jam continues to be detected, it is determined that a sheet jam occurs.

FIG. 3 is a block diagram of the erasing apparatus 100. A ROM 202, a RAM 203, the pair of heaters 205 of the erasing section 116, and a communication interface (I/F) 206 that receives input of data from the outside and outputs data to the outside are connected to a CPU (Central Processing Unit) 200, which is a control section of the erasing apparatus 100, via a system bus 201. The CPU 200 communicates with a client PC and a server using the communication I/F 206 connected via the system bus 201.

The double-feed detection sensor 113 and the sheet detection sensors 121 and 122 are connected to the CPU 200. Further, a sheet-conveyance-motor control section 208 configured to control a sheet conveyance motor 209 for driving the conveying roller 115, an electromagnetic-clutch control section 215 configured to drive an electromagnetic clutch 216, the operation section 210, and the display section 211 are connected to the CPU 200. Detection results of the double-feed detection sensor 113 and the sheet detection sensors 121 and 122 are transmitted to the CPU 200 as detection signals.

A computer program for causing the CPU 200 to operate is stored in the ROM 202. As the heaters 205, IH heaters or the like are used. The heaters 205 apply heat to both sides of the sheet P to make the color material colorless while the sheet P passes through the erasing section 116.

The CPU 200 determines, on the basis of the detection results of the various sensors, in which position in the erasing apparatus 100 a sheet jam occurs. The CPU 200 controls the conveyance of the sheet P according to a place of the occurrence of the sheet jam. The CPU 200 controls, according to a state of the sheet P when the sheet jam occurs, a conveying direction in which the sheet P is conveyed to the outside of the erasing section 116. When the sheet jam occurs, if the first sheet detection sensor 121 or the second sheet detection sensor 122 detects the sheet P, the CPU 200 can determine that the sheet P is present in the erasing section 116. When the sheet jam occurs, if the double-feed detection sensor 113 detects the sheet P, the CPU 200 can determine that the sheet P is present near the paper feeding section 110. When the sheet jam occurs, if the sheet detection sensor 124 detects the sheet P, the CPU 200 can determine that the sheet P is present near the paper discharge section 119.

When the sheet jam occurs, if the sheet P present in the erasing section 116 is unconveyable in the conveying direction, the CPU 200 conveys the sheet P in a direction opposite to the conveying direction. When the sheet jam occurs, if the sheet P present in the erasing section 116 is conveyable in the conveying direction, the CPU 200 conveys the sheet P in the conveying direction. When a jam occurs in a state in which the sheet P is present in the erasing section 116, first, the CPU 200 conveys the sheet P present in the erasing section 116 in the conveying direction. If the first sheet detection sensor 121 or the second sheet detection sensor 122 detects the sheet P even if a fixed number of pulses elapse, the CPU 200 determines that conveyance is impossible. If the CPU 200 determines that conveyance is impossible, the CPU 200 conveys the sheet P in the direction opposite to the conveying direction and conveys the sheet P to the outside of the erasing section 116.

When the sheet P present in the erasing section 116 is conveyed in the conveying direction and the fixed number of pulses elapse, if the first sheet detection sensor 121 or the second sheet detection sensor 122 does not detect the sheet P, the CPU 200 determines that the sheet P is conveyed to the outside of the erasing section 116. Thereafter, the CPU 200 further conveys the sheet P in the conveying direction and discharges the sheet P to the paper discharge section 119. If the sheet detection sensor 124 detects the sheet P even if the fixed number of pulses elapse after the second sheet detection sensor 122 detects the sheet P, the CPU 200 determines that the sheet P is present near the paper discharge section 119.

When a jam occurs, the CPU 200 stops the rotation of the pickup roller 111, the separation roller 112, the registration roller 114, the conveying rollers 115 and 123, and the discharge roller 118.

A series of flow of the erasing processing for the sheet P is explained. The sheets P stacked on the paper feeding section 110 are conveyed into the conveying path 117 one by one by the pickup roller 111. The sheet P picked up from the paper feeding section 110 by the pickup roller 111 is sequentially conveyed by the separation roller 112, the registration roller 114, and the conveying roller 115. An image on the sheet P is erased by the erasing section 116. The sheet P is conveyed by the conveying roller 123. The sheet P on which the image is erased is discharged to the paper discharge section 119 by the discharge roller 118.

Figure 4:
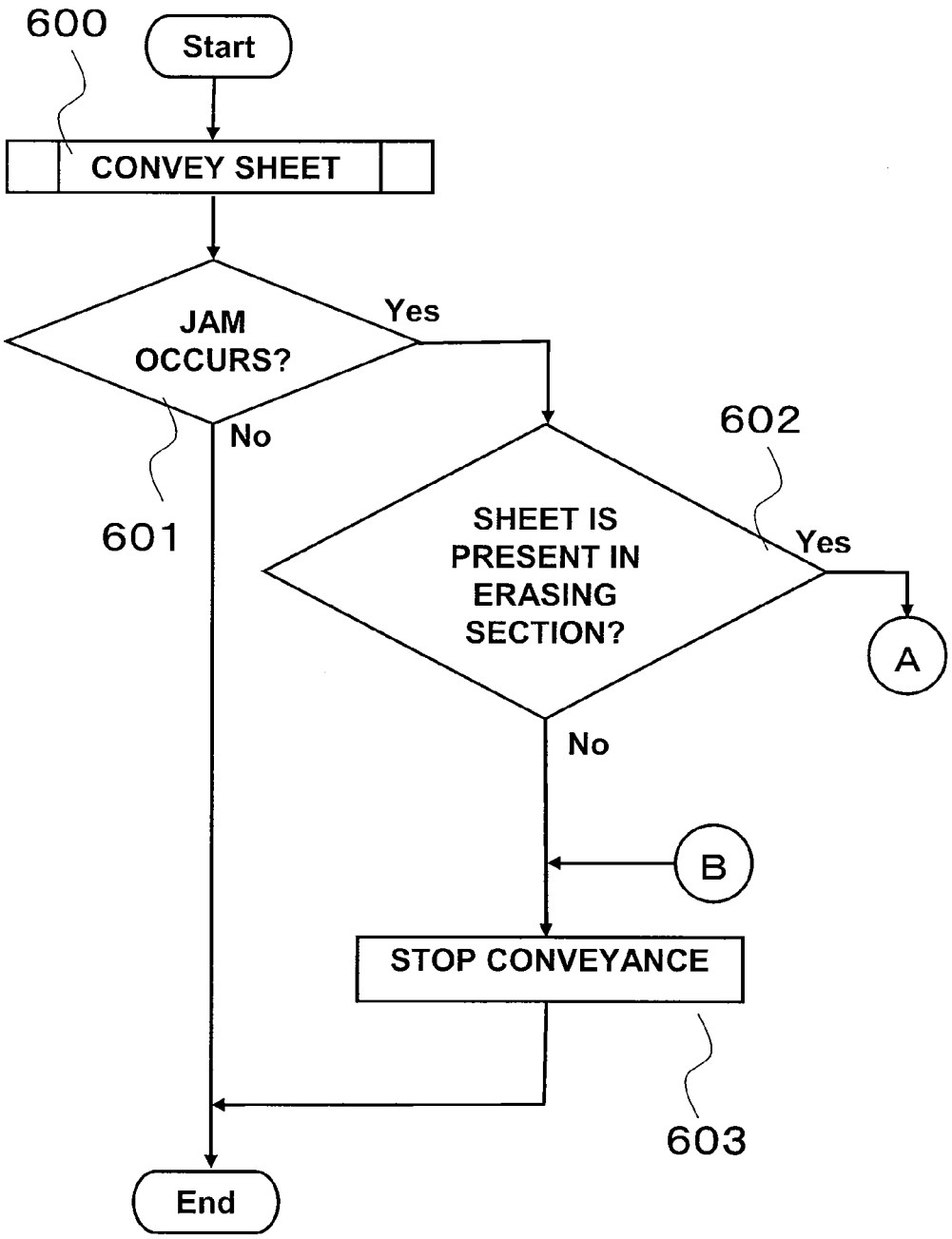
FIG. 4 is a flowchart for explaining conveyance control performed when a sheet jam occurs in the first embodiment.
Figure 5:
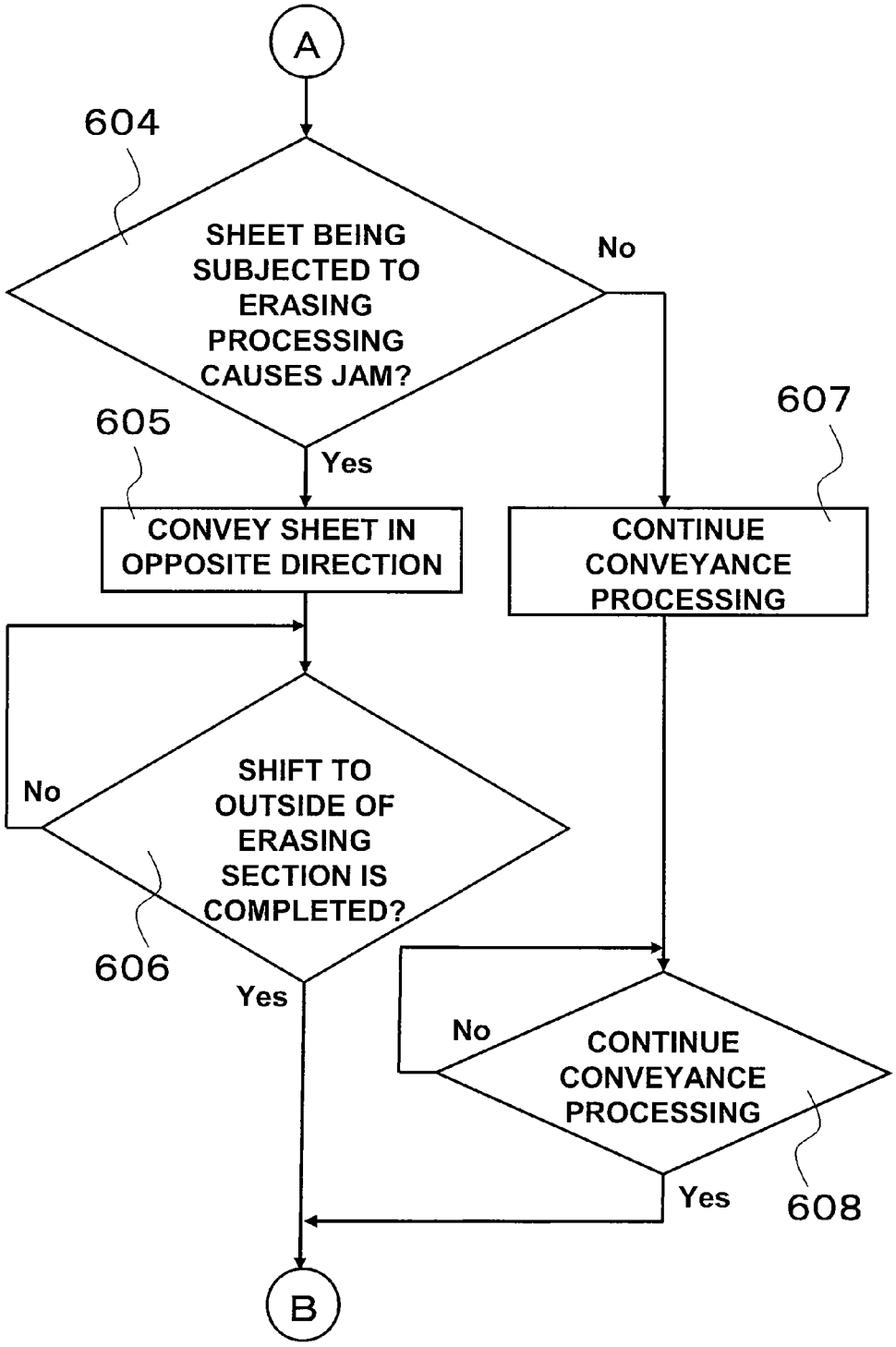
FIG. 5 is a flowchart following FIG. 4 for explaining the conveyance control performed when a sheet jam occurs in the first embodiment.

FIGS. 4 and 5 are flowcharts for explaining conveyance control for the sheet P performed when a sheet jam occurs. In Act 600, the CPU 200 conveys the sheet P. In Act 601, the CPU 200 determines whether a sheet jam occurs. If a sheet jam does not occur (No in Act 601), the CPU 200 ends the processing. When a sheet jam occurs (Yes in Act 601), in Act 602, the CPU 200 determines whether the sheet P is present in the erasing section 116. If the sheet P is absent in the erasing section 116 (No in Act 602), in Act 603, the CPU 200 stops the conveyance of the sheet P and ends the conveyance control.

If the sheet P is present in the erasing section 116 (Yes in Act 602), in Act 604 in FIG. 5, the CPU 200 determines whether the sheet P being subjected to the erasing processing causes a jam. If the sheet P being subjected to the erasing processing causes a jam (Yes in Act 604), in Act 605, the CPU 200 conveys the sheet P in the direction opposite to the conveying direction. The CPU 200 reversely rotates the conveying rollers 115 and 123 and conveys the sheet P in the direction opposite to the conveying direction. Thereafter, in Act 606, the CPU 200 determines whether transfer of the sheet P to the outside of the erasing section 116 is completed. If the transfer to the outside of the erasing section 116 is not completed, the CPU 200 repeats the determination in Act 606. If the transfer to the outside of the erasing section 116 is completed (Yes in Act 606), the CPU 200 returns to FIG. 4. In Act 603, the CPU 200 stops the conveyance and ends the conveyance control.

If the sheet P being subjected to the erasing processing does not cause a jam (No in At 604 in FIG. 5), in Act 607, the CPU 200 continues the conveyance processing. In Act 608, the CPU 200 determines whether the discharge is completed. If the discharge is not completed (No in Act 608), the CPU 200 repeats the determination in Act 608. If the discharge is completed (Yes in Act 608), the CPU 200 returns to FIG. 4. In Act 603, the CPU 200 stops the conveyance and ends the conveyance control. If the sheet P being subjected to the erasing processing does not cause a jam, the CPU 200 may continue the erasing processing and discharge the sheet P to the paper discharge section 119.

Figure 6:
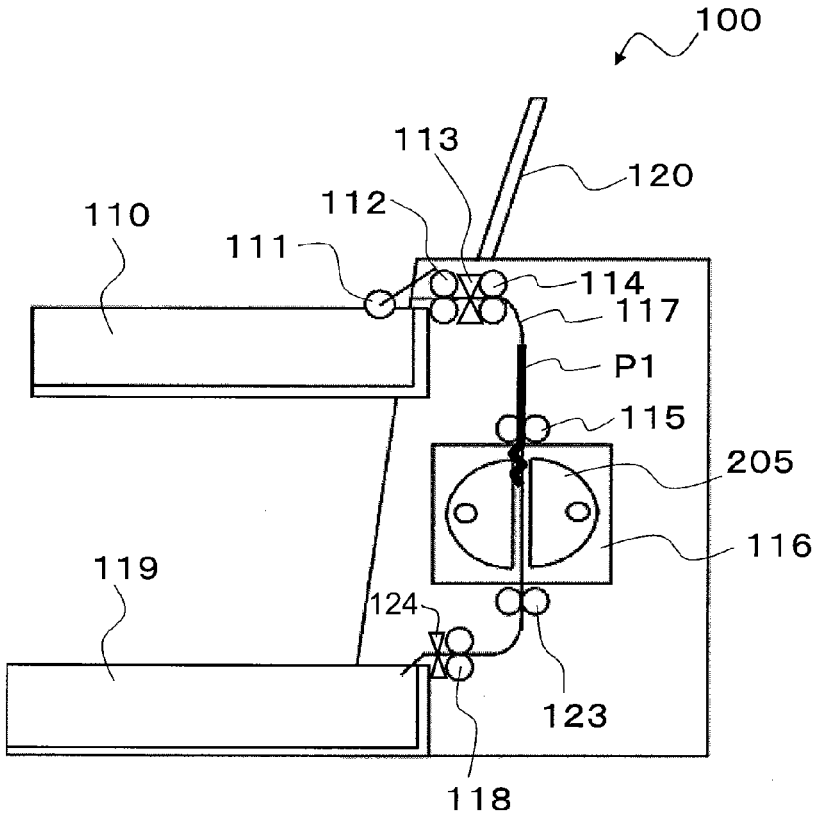
FIG. 6 is a diagram of a sheet jam in the erasing section in the first embodiment.

First, conveyance control performed when a sheet P1 being subjected to the erasing processing causes a jam in the erasing section 116 is explained. FIG. 6 is a diagram of the jam of the sheet P1 in the erasing section 116. If the sheet P1 being subjected to the erasing processing causes a jam on an inlet side in the erasing section 116 as shown in FIG. 6 (Yes in Act 604), the CPU 200 conveys the sheet P1 in the direction opposite to the conveying direction and conveys the sheet P1 to the outside of the erasing section 116. An arrow indicates a traveling direction of the sheet P1 conveyed in the direction opposite to the conveying direction of the sheet P1.

Figure 7:
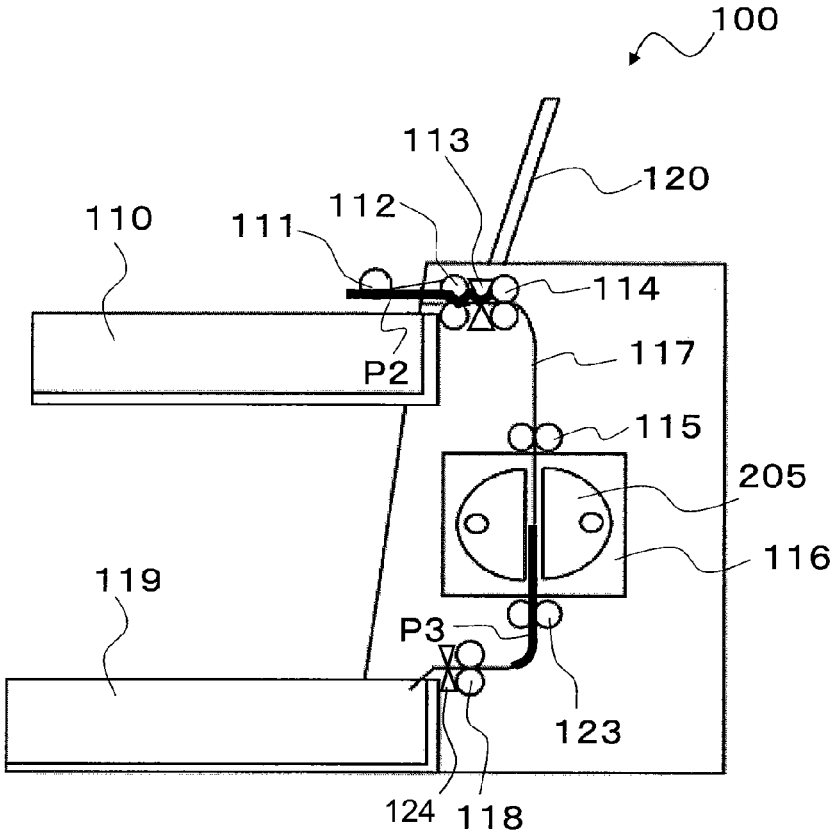
FIG. 7 is a diagram of a state in which a sheet causes a jam in a paper feeding section of the erasing apparatus and the sheet remains in the erasing section in the first embodiment.

Conveyance control performed when a sheet jam is caused by a sheet other than a sheet being subjected to the erasing processing and the sheet being subjected to the erasing processing remains in the erasing section 116 is explained. FIG. 7 is a diagram of a state in which a sheet P2 causes a jam in the paper feeding section 110 of the erasing apparatus 100 and a sheet P3 fed earlier remains on an outlet side of the erasing section 116. If the erasing processing is applied to the plural sheets P2 and P3 and a jam of a sheet other than a sheet being subjected to the erasing processing, i.e., the sheet P2 occurs and the conveyance processing for the sheet P3 being subjected to the erasing processing can be continued (No in Act 604), the CPU 200 continues the conveyance processing and transfers the sheet P3 to the outside of the erasing section 116. If the sheet P3 can be directly conveyed to the paper discharge section 119, the CPU 200 may perform processing up to discharge processing to the paper discharge section 119. After the discharge processing for the sheet P3, the CPU 200 stops the conveyance of the sheets.

If the sheet P1 being subjected to the erasing processing causes a jam in the erasing section 116 and remains in the erasing section 116, it is likely that the sheet P1 is burned by the heaters 205. However, by performing the conveyance control explained above, it is possible to convey the sheet P1 to the outside of the erasing section 116 and safely stop the erasing apparatus 100.

When a sheet jam occurs on the downstream side in the sheet conveying direction of the erasing section 116, the CPU 200 may forcibly discharge the sheet P that causes the jam. For example, after determining that a sheet jam occurs downstream of the erasing section 116, the CPU 200 stops the operation of the heaters 205, which are heat sources, and thereafter forcibly discharges the sheet P that causes the jam. In the above explanation, if the second sheet detection sensor 122 does not detect the sheet P even if 115 pulses elapse after the first sheet detection sensor 121 detects the sheet P1 until the second sheet detection sensor 122 detects the sheet P1, the CPU 200 determines that a sheet jam occurs. However, the CPU 200 may determine that a sheet jam occurs after the number of pulses slightly larger than 115 pulses, for example, 150 pulses elapse. Further, if the forcible conveyance cannot be performed, the CPU 200 may convey the sheet in the direction opposite to the conveying direction.

In the above description, when a sheet jam occurs in a state in which the sheet P is present in the erasing section 116, the CPU 200 stops the conveyance after transferring the sheet P in the erasing section 116 to the outside of the erasing section 116. However, the CPU 200 may apply transfer processing of the sheet P from the erasing section 116 after once stopping the conveyance.

The CPU 200 performs, with the display section 211, display for informing a user that a sheet jam occurs. As timing for the display, it is advisable to perform the display after the stop of the conveyance (Act 603 in FIG. 4) after the transfer of the sheet P from the erasing section 116. If the user opens a cover of the erasing device 100, the conveyance processing for the sheet P is forcibly stopped. Therefore, the CPU 200 displays the occurrence of the sheet jam on the display section 211 after the conveyance processing for the sheet P to prevent the conveyance processing for the sheet P from being forcibly stopped. For example, if the sheet P being subjected to the erasing processing causes a jam and the occurrence of the jam is displayed on the display section 211, the user sometimes opens the cover of the erasing apparatus 100 in order to remove the sheet jam during the conveyance processing for the jammed sheet in the opposite direction. However, the CPU 200 displays the occurrence of the sheet jam on the display section 211 after the end of the conveyance to prevent the user from carelessly opening the cover of the erasing apparatus 100. Further, a sheet other than the sheet P in the erasing section 116 causes a jam in a state in which the sheet P is present in the erasing section 116, the user sometimes opens the cover of the erasing apparatus 100 in order to remove the sheet jam during continuation of the conveyance processing for the sheet if the sheet jam is displayed on the display section 211. However, the CPU 200 displays the occurrence of the sheet jam on the display section 211 after the end of the conveyance to prevent the user from opening the cover of the erasing apparatus 100.

Figure 8:
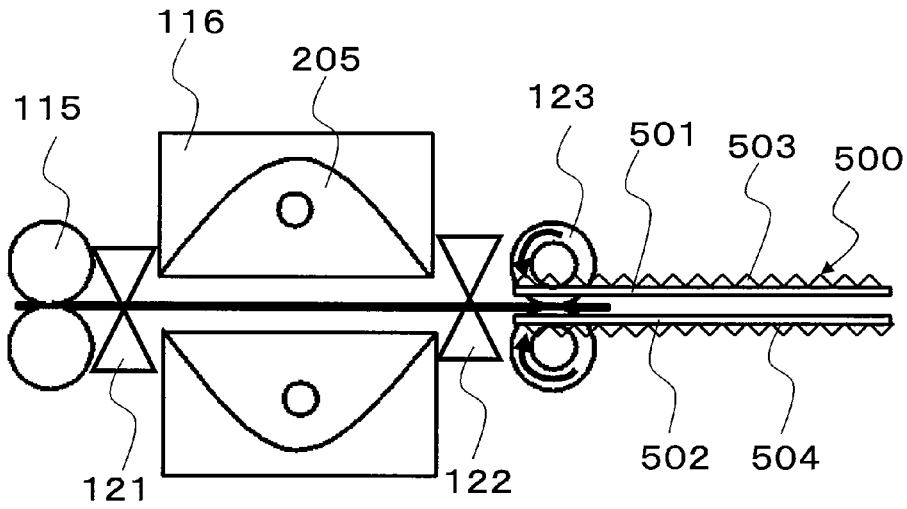
FIG. 8 is a diagram of the erasing section in a state in which an shutter is open in the first embodiment.

An shutter driving section for a heater provided in the erasing section 116 of the erasing apparatus 100 is explained. The erasing apparatus 100 may include an shutter driving section 520 shown in FIG. 9. In the shutter driving section 520, an shutter 500 configured to cover a conveying path surface of the erasing section 116 operates if the conveying roller 115 (shown in FIG. 8) upstream of the erasing section 116 is driven in the conveying direction. FIG. 8 is a diagram of the erasing section including an shutter. An arrow indicates the conveying direction of the sheet P.

The shutter 500 includes a first shutter 501 (shown in FIG. 8) including a first rack gear 503 and a second shutter 502 (shown in FIG. 8) including a second rack gear 504. The shutter 500 opens during a erasing operation and closes when the erasing operation ends and when a sheet jam occurs. In FIG. 8, the erasing section 116 indicating a state in which the shutter 500 is open (a state in which the heaters 205 are opened to the sheet conveying path) during the erasing operation is shown. During the end of the erasing operation, the shutter 500 is in a closed state. In other words, the heaters 205 are closed from the conveying path by the shutter 500.

Figure 9:
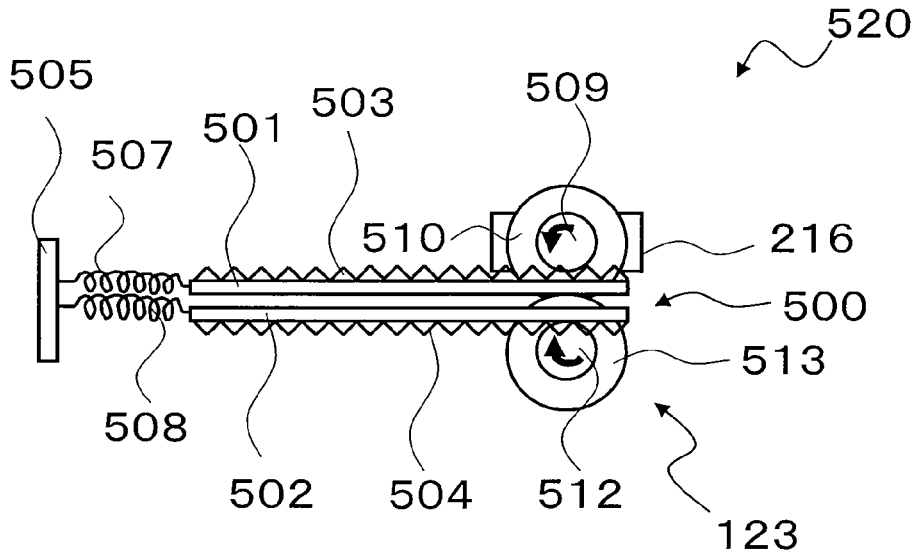
FIG. 9 is a diagram of an shutter driving section in a state in which the shutter is closed in the first embodiment.

FIG. 9 is a diagram of the shutter driving section 520 in a state in which the shutter 500 is closed. A home position of the shutter driving section 520 is shown in FIG. 9. The shutter driving section 520 includes a first shutter 501, a second shutter 502, a spring retaining section 505, a first spring 507, a second spring 508, and a conveying roller 123.

The first shutter 501 opens along the sheet conveying path according to the rotation of a first gear 509. The second shutter 502 covers the heaters 205, which are the heat sources, along the sheet conveying path according to the rotation of a second gear 512. The first spring 507 connects the first shutter 501 and the spring retaining section 505. The second spring 508 connects the second shutter 502 and the spring retaining section 505. The first shutter 501 and the second shutter 502 are urged in the direction of the spring retaining section 505 respectively by the springs 507 and 508.

The conveying roller 123 includes the first gear 509 attached with an electromagnetic clutch 216, a first roller 510, the second gear 512, and a second roller 513. If the electromagnetic clutch 216 is ON, the first roller 510, the second gear 512, and the second roller 513 rotate in an arrow direction shown in FIG. 13 according to the rotation of the first gear 509. If the electromagnetic clutch 216 is OFF, the first gear 509 idly rotates.

For opening and closing of the shutter 500, driving force of the conveying roller 115 (shown in FIG. 8) upstream of the erasing section 116 is transmitted to the electromagnetic clutch 216 to open the shutter 500. On the other hand, when the shutter 500 is returned to a home position from a state in which the shutter 500 is opened, if the electromagnetic clutch 216 is turned off, since the first shutter 501 and the second shutter 502 are urged to the spring retaining section 505 side, the first shutter 501 and the second shutter 502 automatically return to original positions. When a predetermined number of pulses elapse after the conveyance of the sheet P is ended by the conveying roller 115 upstream of the erasing section 116, the electromagnetic clutch 216 is turned off.

The opening and closing of the shutter 500 may be performed every time one sheet P is conveyed or every time one job is performed. The returning the shutter 500 to the original position (the home position) from the open state is not limited to the configuration for automatically returning the shutter 500 with the springs. The first gear 509 may be reversely rotated.

Usually, since the temperature of the erasing section 116 rises, when the cover is opened to, for example, remove a sheet jam, it is inappropriate to open the cover before the temperature of the erasing section 116 falls to temperature low enough for the user to touch the erasing section 116. However, by adopting the configuration explained above, when a jam of the sheet P occurs, the heat sources can be easily covered with the shutter 500 even in a state in which the temperature of the erasing section 116 is high. In removing the sheet P, it is unnecessary to wait until the erasing section 116 is cooled.

When a sheet jam occurs, even if the sheet P is present in the erasing section 116, the erasing apparatus 100 can safely stop. Since the erasing apparatus 100 includes the shutter 500, when a jam of the sheet P occurs, the cover can be easily opened and closed even if the temperature of the erasing section 116 is high. In removing the sheet P, it is unnecessary to wait until the erasing section 116 is cooled.

Second Embodiment

A erasing apparatus according to a second embodiment shown in FIGS. 10 to 19 is a erasing apparatus that reads an image with the same reading section before and after image erasing. If the erasing apparatus has to be stopped in a state in which a sheet is present in a erasing section, the erasing apparatus moves the sheet in the erasing section from the erasing section.

Figure 10:
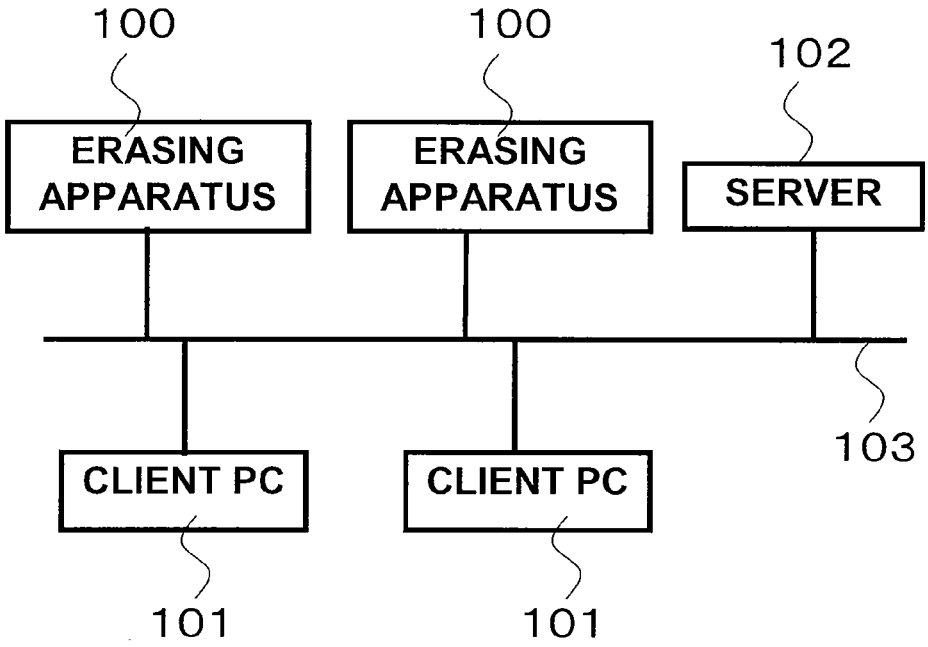
FIG. 10 is a system configuration diagram in a second embodiment.

FIG. 10 is a system configuration diagram according to the second embodiment. An image storing system includes, as a system configuration, for example, plural erasing apparatuses 100, plural client PC (Personal Computers) 101, and a server 102. The components of the system are connected via a network 103 such as a LAN (Local Area Network).

Figure 11:
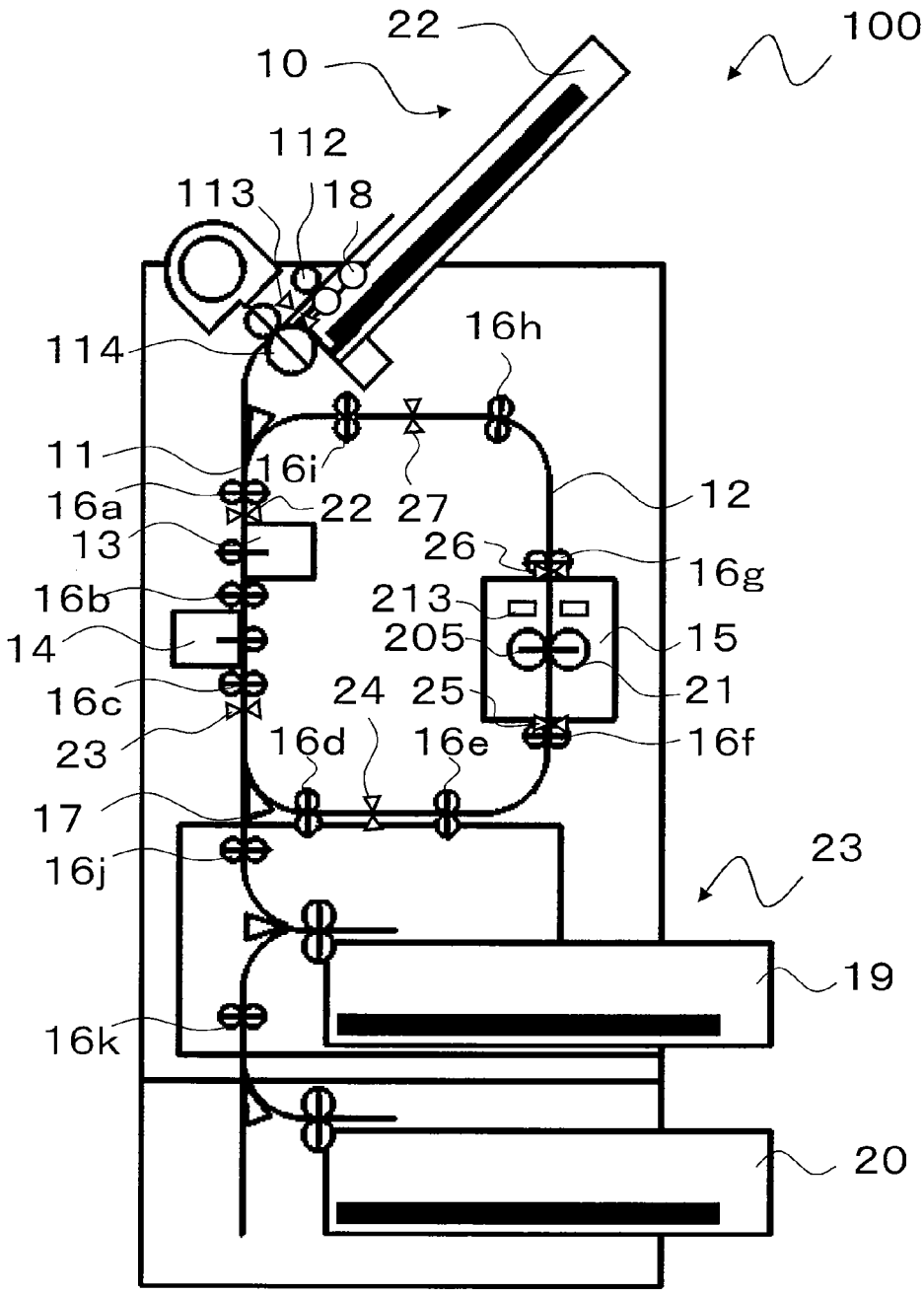
FIG. 11 is a configuration diagram of a erasing apparatus in the second embodiment.

FIG. 11 is a configuration diagram of the erasing apparatus. The erasing apparatus 100 erases an image on a sheet (a recording medium) subjected to image formation by an image forming apparatus and enables reuse of the sheet. The erasing apparatus 100 includes a paper feeding section 10, a first conveying path 11, a second conveying path 12, a first reading section 13, a second reading section 14, a erasing section 15, a conveying roller 16, a path changing section 17, a first paper discharge section 19, and a second paper discharge section 20.

The paper feeding section 10 stores the sheets P to be reused. The paper feeding section 10 feeds the sheets P to the inside of the erasing apparatus 100 in order to erase images formed on the sheets P with a erasable color material. The paper feeding section 10 includes a paper feeding tray 22, a pickup roller 18, the separation roller 112, the double-feed detection sensor 113, and the registration roller 114. The sheets P are stacked on paper feeding tray 10. The pickup roller 18 picks up the sheets P from the paper feeding tray 10 one by one and delivers the sheet P to the first conveying path 11.

The first conveying path 11 and the second conveying path 12 include plural conveying rollers 16. The conveying rollers 16 include conveying rollers 16*a*, 16*b*, 16*c*, 16*d*, 16*e*, 16*f*, 16*g*, 16*h*, 16*i*, 16*j*, and 16*k* and are formed by pairs of driving rollers and driven rollers. The first reading section 13 and the second reading section 14 are arranged along the first conveying path 11. The first reading section 13 and the second reading section 14 include two-dimensional CCD scanners. The first reading section 13 scans one side of the sheet P conveyed from the paper feeding section 10. The second reading section 14 scans a side on the opposite side of the side read by the first reading section 13. Images read by the scanning by the first reading section 13 and the second reading section 14 are stored in a RAM (Random Access Memory) 203, which is a storing section. A storage destination of the images read by the first reading section 13 and the second reading section 14 is not limited to the RAM 203 and may be an HDD (Hard Disk Drive), a magneto-optical memory, or the like. The images temporarily stored in the RAM 203 may be sent to and stored in the HDD, for example, at a point when erasing processing ends.

The images read by the first reading section 13 and the second reading section 14 are not limited to the storage in the RAM 203 of the erasing apparatus 100. The images may be stored in a RAM 302 of the client PC 101 or a RAM 402 of the server 102 shown in FIG. 12. If the erasing apparatus 100 is the erasing apparatus 100 including a long-in and long-out function in order to perform personal authentication of a user, during log-out from the erasing apparatus 100, data of the images stored in the RAM 203 of the erasing apparatus 100 may be transmitted to and stored in the RAM 302 of the client PC 101 or the RAM 402 of the server 102.

The first reading section 13 and the second reading section 14 read the surface of the sheet P in order to determine whether the sheet P is reusable and printing on the sheet P is erased.

The reading by the first reading section 13 and the second reading section 14 is performed twice. In the first reading, the first reading section 13 and the second reading section 14 digitize read images and store the images in the storing section. In the second reading after erasing, the first reading section 13 and the second reading section 14 determine whether the sheet P is reusable.

In the first reading, the first reading section 13 and the second reading section 14 may store the images and determine whether the sheet P is unreusable because of creases, staples, unerasable notes, or the like. In this case, if it is determined in the first reading that the sheet P is in a reusable state, the first reading section 13 and the second reading section 14 apply the erasing processing to the sheet P. In the second reading, the first reading section 13 and the second reading section 14 determine whether the images on the sheet P are erased and discharge the sheet P to, for example, the first paper discharge section 19. If it is determined in the first reading that the sheet P is in an unreusable state, the first reading section 13 and the second reading section 14 apply the erasing processing to the sheet P and discharge the sheet P to, for example, the first paper discharge section 19 without performing the second reading. If it is determined in the first reading that the sheet P is in the unreusable state, the first reading section 13 and the second reading section 14 may discharge the sheet P to, for example, the first paper discharge section 19 without performing the erasing processing and the second reading. These kinds of setting can be selected and made in advance. The first reading section 13 and the second reading section 14 are not limited to the pair of two-dimensional CCD scanners and may be CMOS sensors.

As shown in FIG. 11, the first conveying path 11 is connected from the paper feeding section 10 to the first paper discharge section 19 or the second paper discharge section 20. The second conveying path 12 branches at a branching point downstream of the first reading section 13 and the second reading section 14 in the first conveying path 11 and merges at a merging point upstream of the first reading section 13 and the second reading section 14 in the first conveying path 11. A first path changing section 17 is arranged at the branching point.

The second conveying path 12 includes the erasing section 15 in the conveying path. The erasing section 15 includes a roller pair 21, the heater 205, a sheet detection sensor 212, and a temperature detecting section 213. The temperature detecting section 213 detects the temperature of the erasing section 15. The roller pair 21 is heated by the heater 205. Heat of fixed or higher temperature is applied to the sheet P via the roller pair 21 heated by the heater 205, whereby the images on the sheet P formed using the erasable color material are heated and the color material is made colorless. The erasing section 15 performs image erasing with the roller pair 21 to thereby enable image erasing of both sides of the sheet P.

A paper discharge section 23 includes the first paper discharge section 19 and the second paper discharge section 20. The sheet P subjected to the various kinds of processing is discharged to the first paper discharge section 19 or the second paper discharge section 20. The user may be allowed to select to which of the first paper discharge section 19 and the second paper discharge section 20 the sheet P is discharged. The sheet P subjected to the discoloring processing and determined as reusable may be discharged to, for example, the first paper discharge section 19 and the sheet P determined as unreusable may be discharged to the second paper discharge section 20 in distinction from the reusable sheet P.

Figure 12:
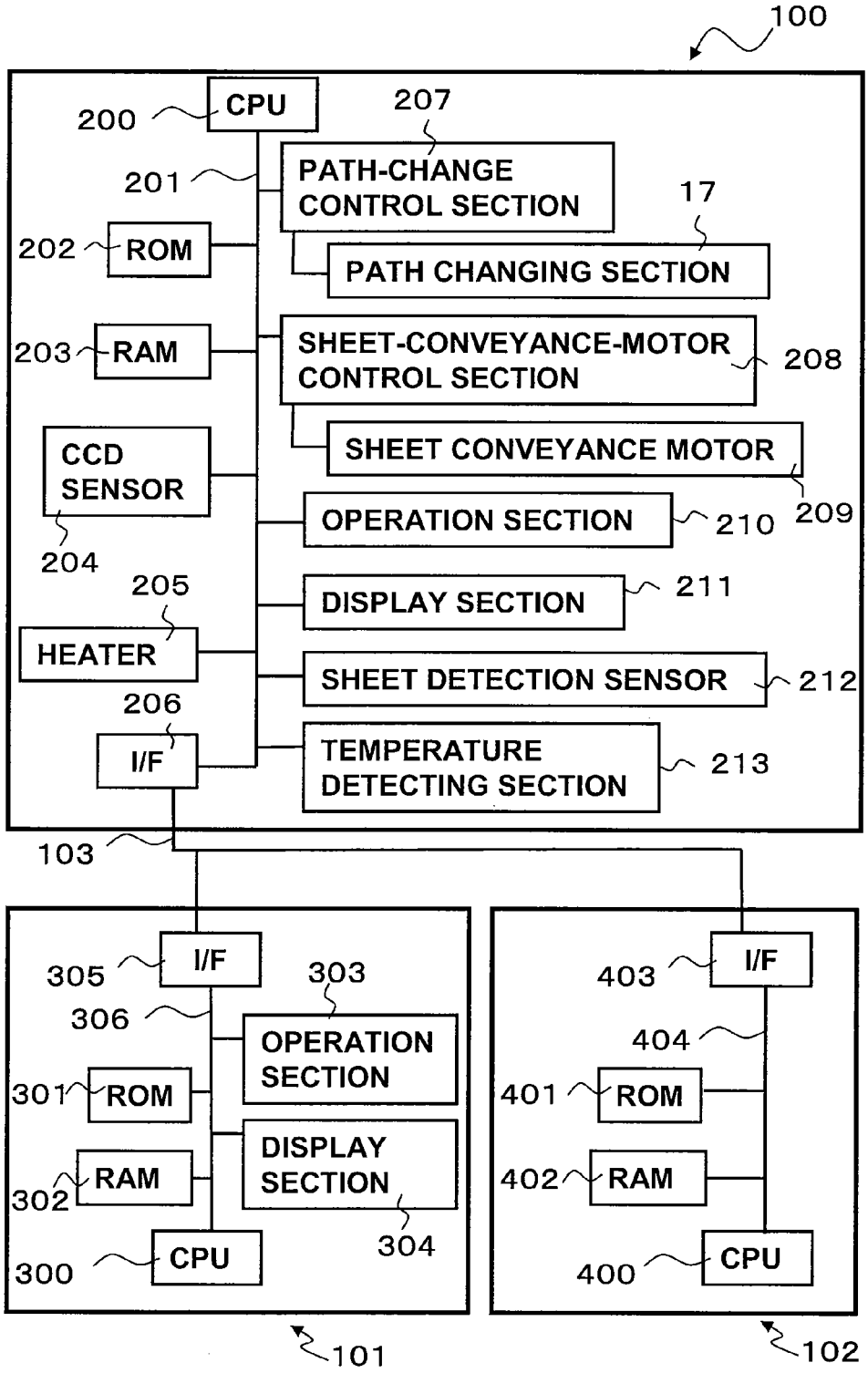
FIG. 12 is a block diagram of the erasing apparatus, a client PC, and a server in the second embodiment.

FIG. 12 is a block diagram of the erasing apparatus 100, the client PC 101, and the server 102. The ROM 202, the RAM 203, CCD sensors 204 of the first reading section 13 and the second reading section 14, the heater 205 of the erasing section 15, the sheet detection sensor 212, and the interface (I/F) 206 that receives input of data from the outside and outputs data to the outside are connected to the CPU (Central Processing Unit) 200, which is the control section of the erasing apparatus 100, via the system bus 201. The CPU 200 communicates with the client PC 101 and the server 102 using the communication I/F 206 connected via the system bus 201.

A path-change control section 207 configured to control the path changing section 17, the sheet-conveyance-motor control section 208 configured to control the sheet conveyance motor 209, the operation section 210, the display section 211, and the sheet detection sensor 212 are connected to the CPU 200. The sheet conveyance motor 209 drives the plural conveying rollers 16 shown in FIG. 16.

In the ROM 202, a computer program for causing the CPU 200 to operate, a printing ratio of a sheet set as a guideline for determining reusability, and a density threshold for determining whether an image is erased are stored. If the depth of creases or the like is determined in the first image reading, a density threshold used for determining the depth of creases or the like is stored. In the RAM 203, an image obtained during image reading for the sheet P is stored. The CCD sensor 204 is arranged as a line of line sensors and detects light and shade of the sheet P. As the heater 205, an IH heater or the like is used. The heater 205 applies heat to the sheet P via the roller pair 21 to make the color material colorless while the sheet P passes through the erasing section 15. After image erasing, the CPU 200 discriminates, on the basis of a read image, whether erasing is normally applied, i.e., the sheet P is reusable.

The operation section 210 includes various keys. The display section 211 displays various processing modes of the erasing apparatus 100. The operation section 210 can select the processing mode. The processing mode comprise scanning processing mode, erasing processing mode, sorting processing mode, and processing mode which combined these modes. The display section 211 may be a touch panel type and may function as an operation section as well.

The sheet detection sensor 212 detects a sheet. The sheet detection sensor 212 includes plural sheet detection sensors 22, 23, 24, 25, 26, and 27, which are arranged in the conveying path. If the second sheet detection sensor 23 does not detect the sheet P within a predetermined number of pulses or a predetermined time after the first sheet detection sensor 22 detects the sheet P, it is determined that a jam occurs. If occurrence of a jam is determined according to the number of pulses, it is determined that a sheet jam occurs, for example, if the second sheet detection sensor 23 does not detect the sheet P when 115 pulses elapse after the first sheet detection sensor 22 detects the sheet P. Concerning occurrence of a sheet jam, a detection result of the sheet detection sensor 212 is transmitted to the CPU 200 and the CPU 200 determines, on the basis of the detection result, whether a sheet jam occurs.

When a sheet jam occurs, if the sheet detection sensor 22 or the sheet detection sensor 23 detects the sheet P, the CPU 200 can determine that the sheet P is present in the reading sections 13 and 14. When a sheet jam occurs, if the sheet detection sensor 25 or the sheet detection sensor 26 detects the sheet P, the CPU 200 can determine that the sheet P is present in the erasing section 15. When a sheet jam occurs, if the sheet detection sensor 24 detects the sheet P, the CPU 200 can determine that the sheet P is present on the upstream side of the erasing section 15 in the second conveying path 12. When a sheet jam occurs, if the sheet detection sensor 27 detects the sheet P, the CPU 200 can determine that the sheet P is present on the downstream side of the erasing section 15 in the second conveying path 12. The temperature detecting section 213 detects the temperature of the erasing section 15.

The CPU 200 controls the path-change control section 207 to thereby drive the path changing section 17 to divert the sheet P to be conveyed from the first conveying path 11 to the second conveying path 12 or divert the sheet P to be conveyed from the first conveying path 11 to the paper discharge section 23.

The client PC 101 includes a CPU 300, a ROM 301, a RAM 302, an operation section 303, a display section 304, and a communication I/F 305. The CPU 300, which is a control section of the client PC 101, is connected to the ROM 301, the RAM 302, the operation section 303, the display section 304, and the communication I/F 305 via a system bus 306.

The server 102 includes a CPU 400, a ROM 401, a RAM 402, and a communication I/F 403. The CPU 400, which is a control section of the server 102, is connected to the ROM 401, the RAM 402, and the communication I/F 403 via a system bus 404.

Parallel processing for performing reading processing, erasing processing, and sorting processing continuously for plural sheets while shifting these kinds of processing for each sheet is explained with reference to FIGS. 13 to 17.

For the erasing processing for the first sheet P, the reading processing by the first reading section 13 and the second reading section 14, which are reading sections, the erasing processing by the erasing section 15, the reading processing by the first reading section 13 and the second reading section 14 again, and the sorting processing for determining whether the sheet P is reusable are carried out in this order.

Figure 13:
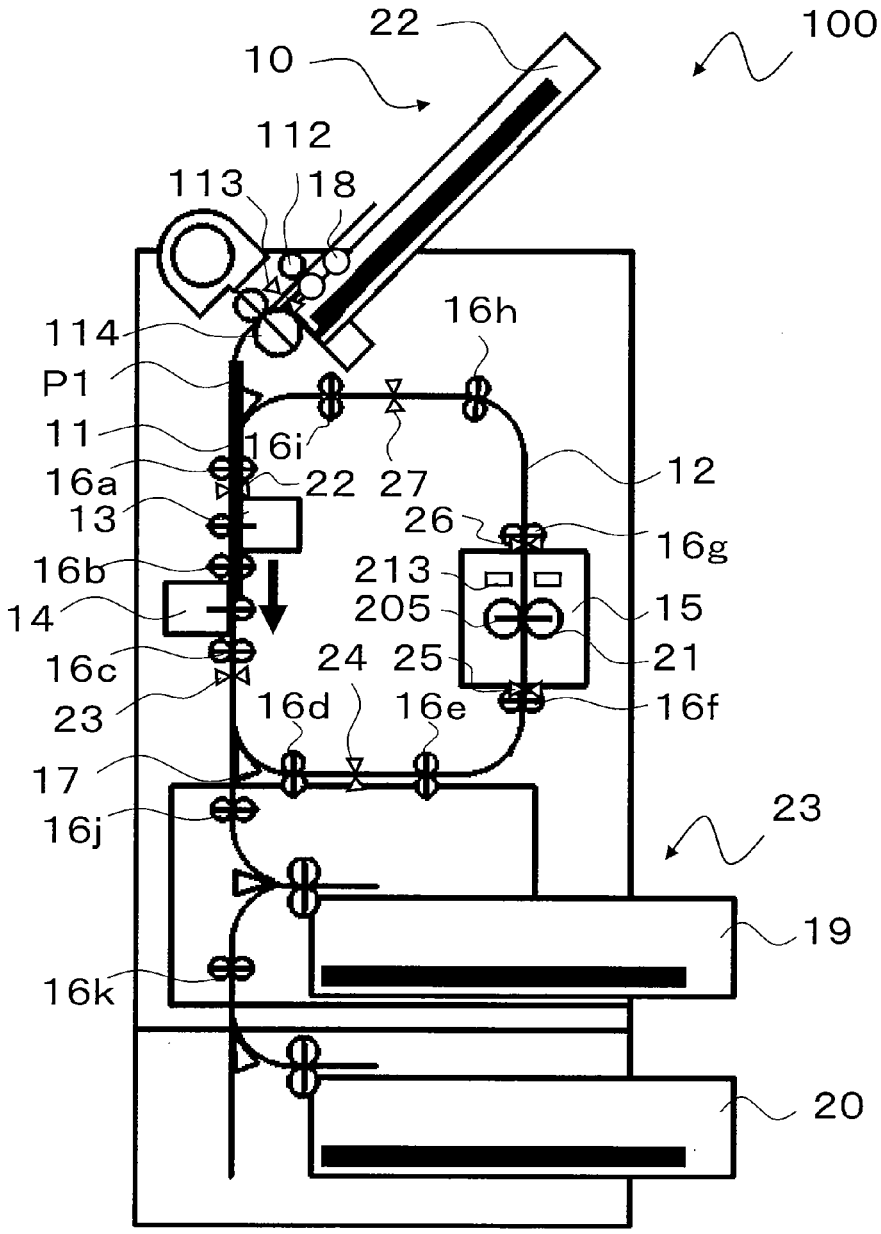
FIG. 13 is a diagram of conveyance of a first sheet in a first conveying path in the second embodiment.

The reading processing, the erasing processing, and the sorting processing continuously performed for three sheets are explained below. The preceding sheet P is represented as first sheet P1 and sheets conveyed following the first sheet P1 are respectively represented as second sheet P2 and third sheet P3 in order. First, as shown in FIG. 13, the first sheet P1 is fed and conveyed through the first conveying path 11. The first sheet P1 is subjected to the reading processing by the first reading section 13 and the second reading section 14.

Figure 14:
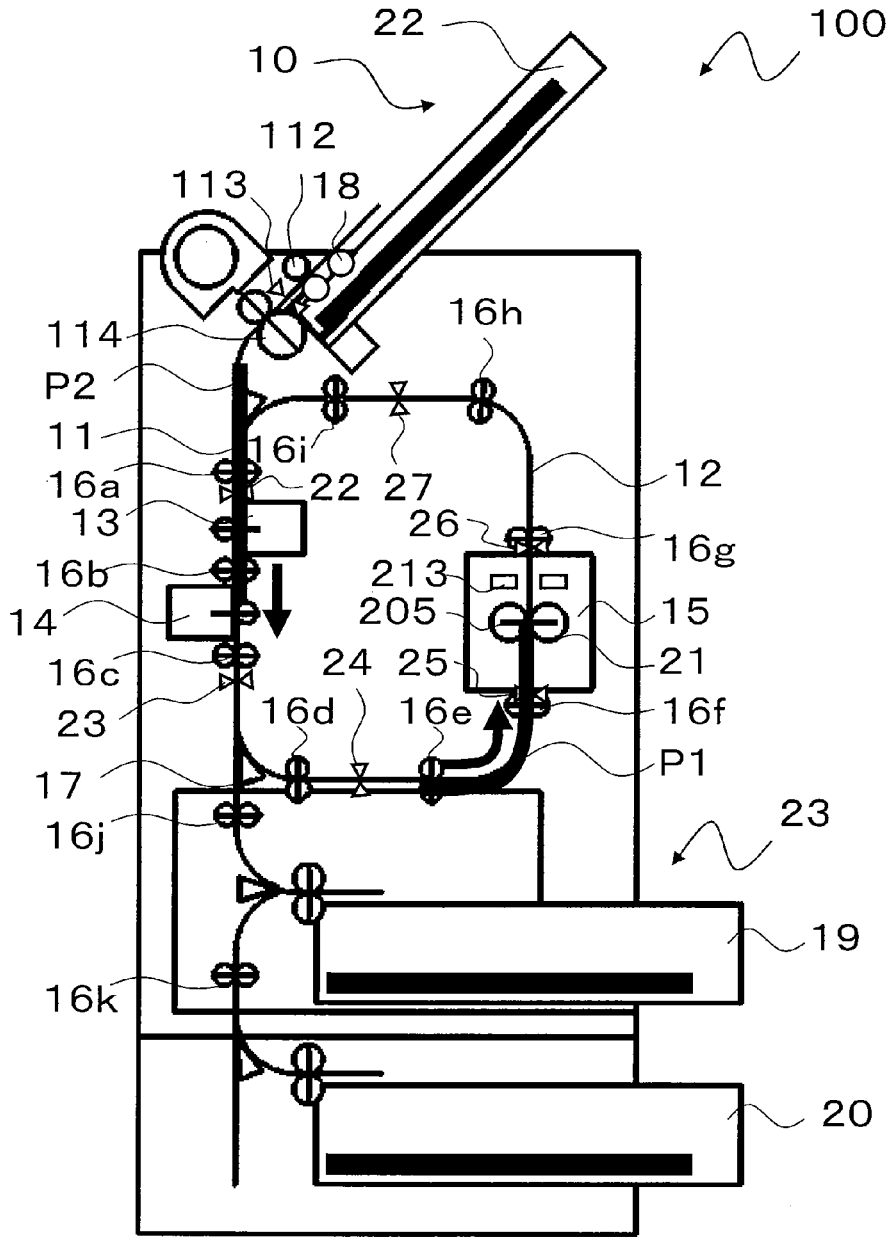
FIG. 14 is a diagram of conveyance of the first sheet in a second conveying path and conveyance of a second sheet in the first conveying path in the second embodiment.

Subsequently, as shown in FIG. 14, the first sheet P1 is conveyed to the second conveying path 12 and subjected to the erasing processing by the erasing section 15. In parallel to the erasing processing for the sheet P1, the second sheet P2 is fed and conveyed to the first conveying path 11. The second sheet P2 is subjected to the reading processing by the first reading section 13 and the second reading section 14.

Figure 15:
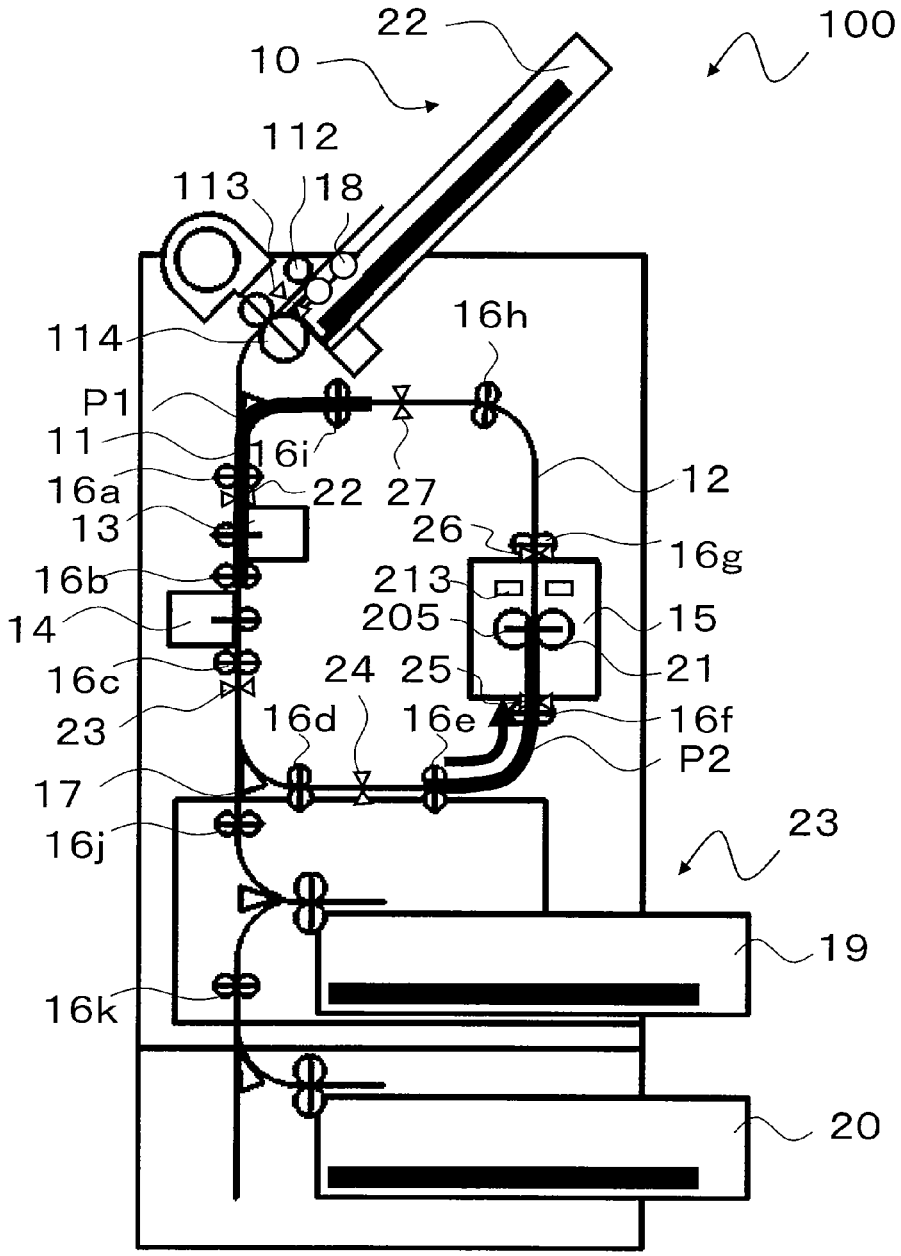
FIG. 15 is a diagram of conveyance of the first sheet from the second conveying path to the first conveying path and conveyance of the second sheet in the second conveying path in the second embodiment.

Thereafter, as shown in FIG. 15, the first sheet P1 is conveyed through the first conveying path 11. An image on the first sheet P1 is read by the first reading section 13 and the second reading section 14. The first sheet P1 is subjected to the sorting processing and discharged to the first paper discharge section 19 or the second paper discharge section 20. In parallel to the sorting processing for the first sheet P1, the second sheet P2 is conveyed to the second conveying path 12. The second sheet P2 is subjected to the erasing processing by the erasing section 15.

Figure 16:
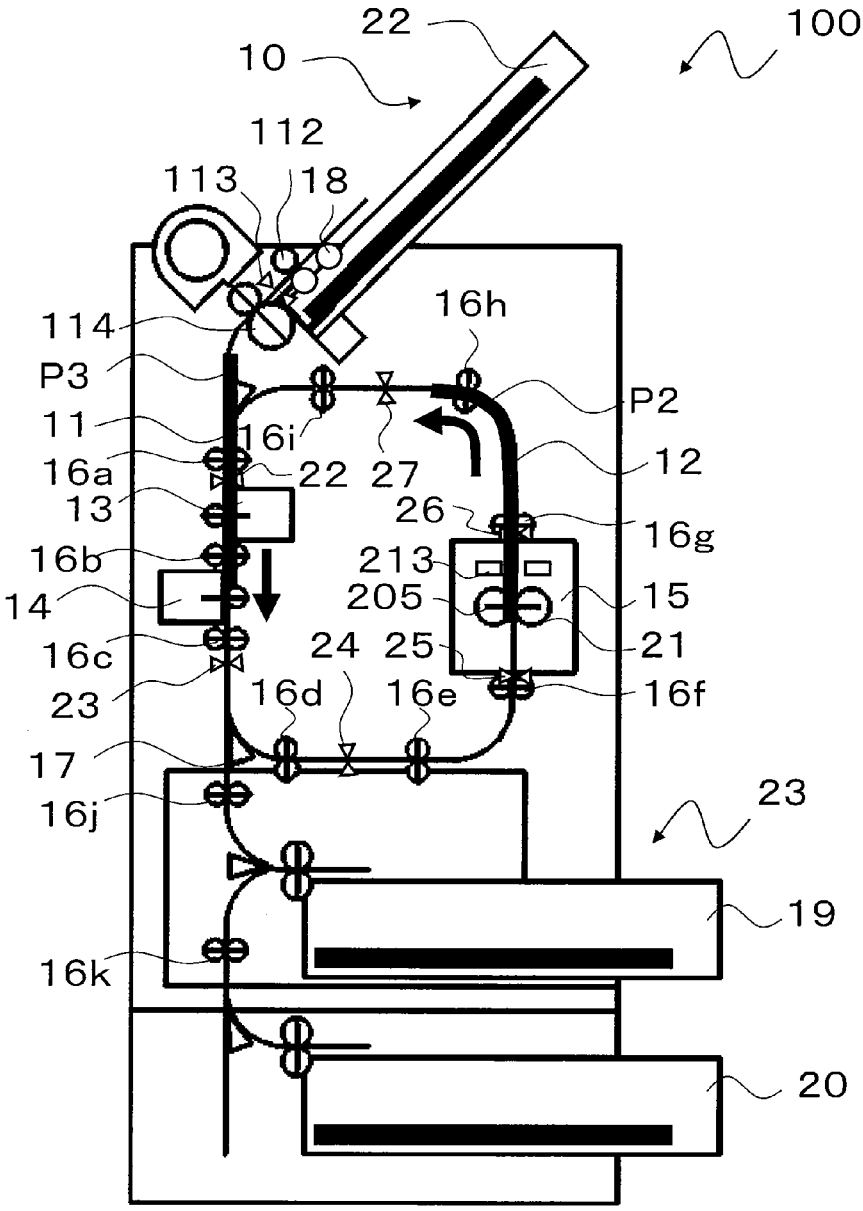
FIG. 16 is a diagram of conveyance of the second sheet in the second conveying path and conveyance of a third sheet in the first conveying path in the second embodiment.

Further, as shown in FIG. 16, in parallel to the erasing processing for the second sheet P2, the third sheet P3 is fed and conveyed through the first conveying path 11. The third sheet P3 is subjected to the reading processing by the first reading section 13 and the second reading section 14.

Figure 17:
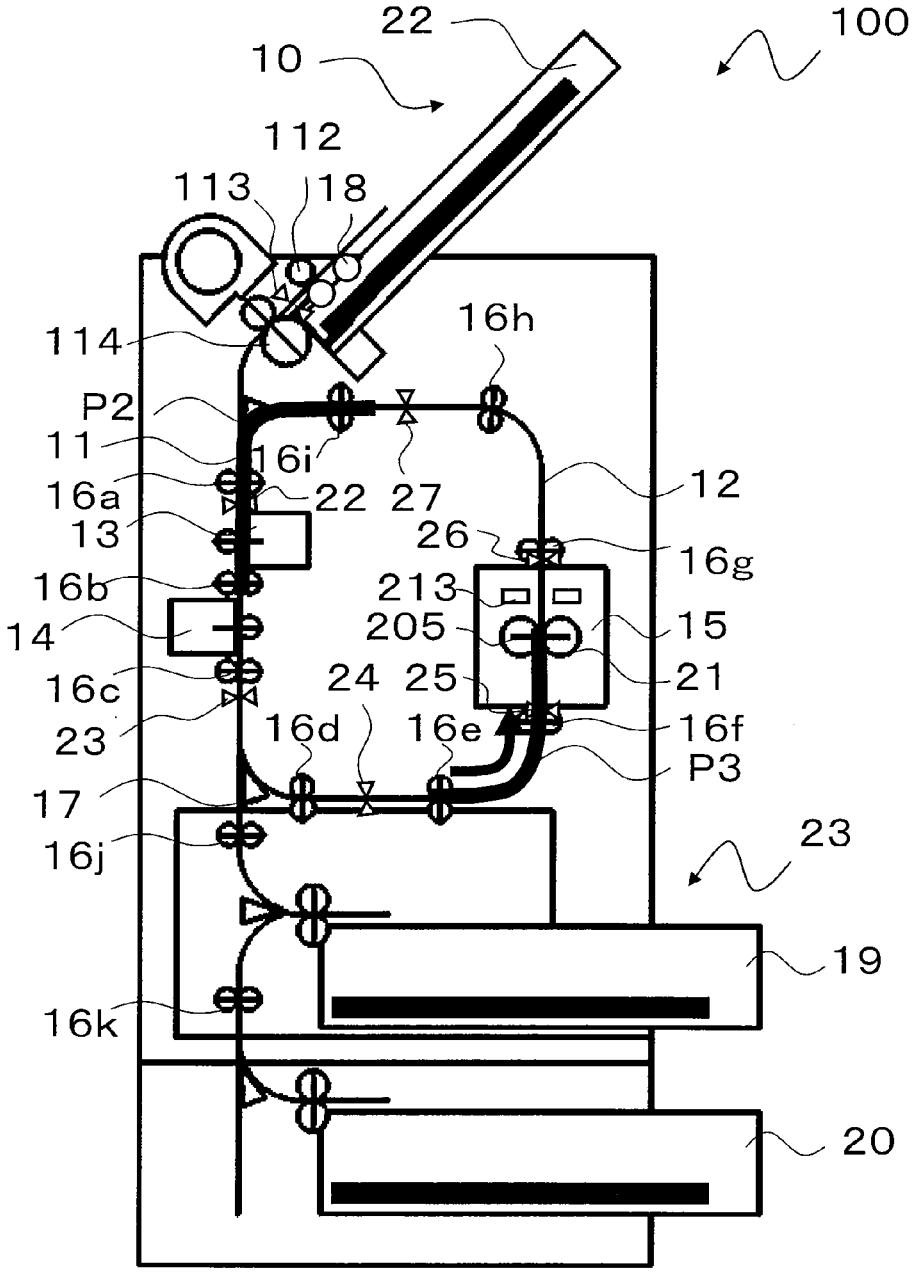
FIG. 17 is a diagram of conveyance of the second sheet from the second conveying path to the first conveying path and conveyance of the third sheet in the second conveying path in the second embodiment.

As shown in FIG. 17, the second sheet P2 is conveyed through the first conveying path 11 again. An image on the second sheet P2 is read by the first reading section 13 and the second reading section 14. The second sheet P2 is subjected to the sorting processing and discharged to the first paper discharge section 19 or the second paper discharge section 20. In parallel to the sorting processing for the second sheet P2, the third sheet P3 is conveyed to the second conveying path 12. The third sheet P3 is subjected to the erasing processing by the erasing section 15. Thereafter, these kinds of processing are repeatedly performed in the same manner as explained above.

When the kinds of processing explained above are repeated, the reading processing is performed in order explained below. The reading processing for a first sheet, the reading processing for a second sheet, the sorting processing for the first sheet, the reading processing for a third sheet, and the sorting processing for the second sheet are performed. Finally, the sorting processing for a (N−2)th sheet, the reading processing for an Nth sheet, the sorting processing for a (N−1)th sheet, and the sorting processing for the Nth sheet are performed. N is an integer.

Figure 18:
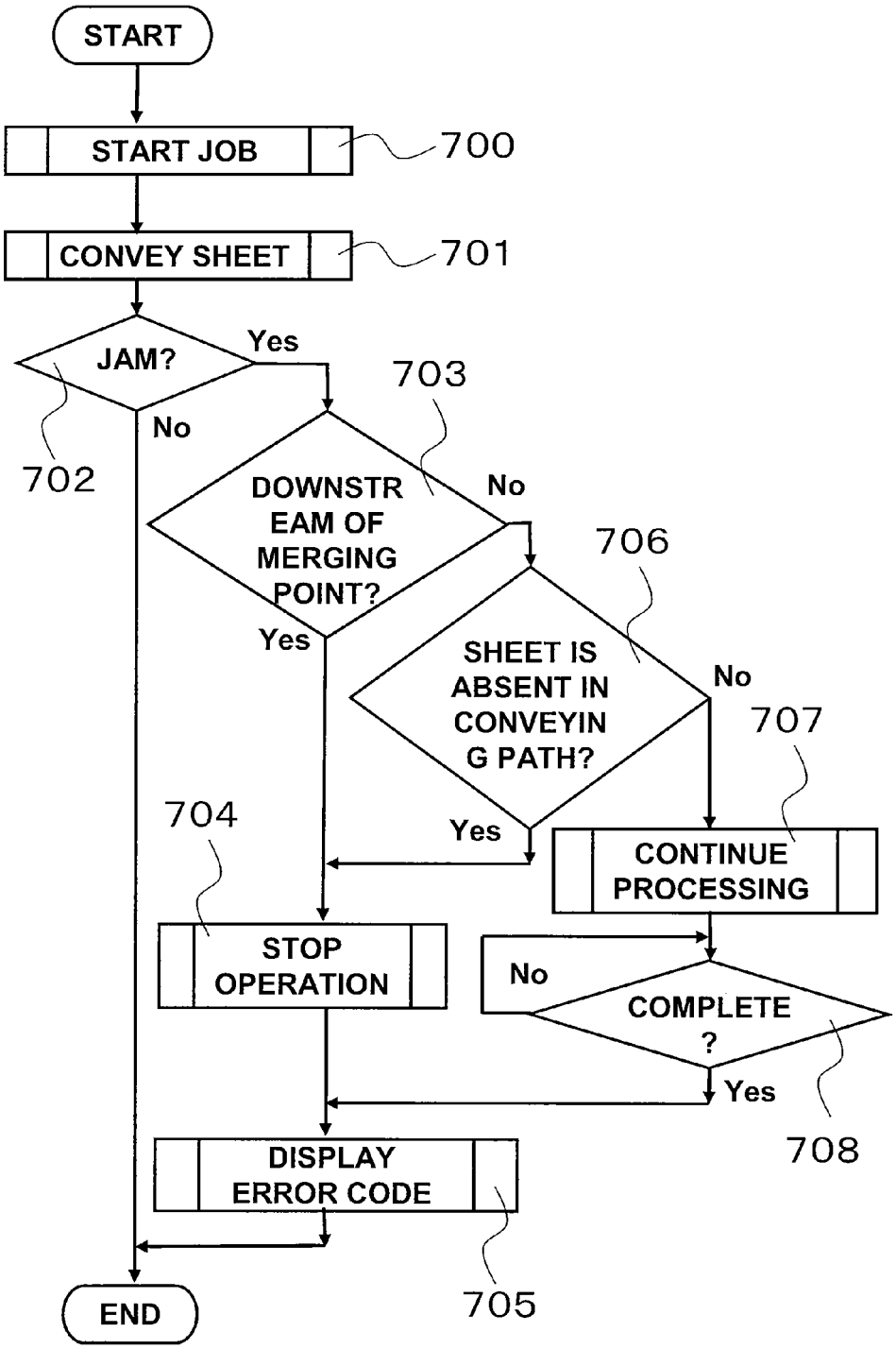
FIG. 18 is a flowchart for explaining conveyance control for a sheet when a jam occurs in the second embodiment.

Conveyance control for a sheet performed when a sheet jam occurs is explained. FIG. 18 is a flowchart for explaining conveyance control for a sheet performed when a sheet jam occurs.

In Act 700, the CPU 200 starts a job. In Act 701, the CPU 200 conveys the sheet P from the paper feeding section 10. In Act 702, the CPU 200 determines whether a sheet jam occurs. If a sheet jam does not occur (No in Act 702), the CPU 200 ends the processing.

When a sheet jam occurs (Yes in Act 702), in Act 703, the CPU 200 determines whether the leading end of the sheet P that causes the jam is present downstream of the merging point of the first conveying path 11 and the second conveying path 12. If the leading end of the sheet P that causes the jam is present downstream of the merging point of the first conveying path 11 and the second conveying path 12 (Yes in Act 703), in Act 704, the CPU 200 stops the operation. In Act 705, the CPU 200 displays, for example, an error code on the display section 211 and ends the processing.

If the leading end of the sheet P that causes the jam is present upstream of the merging point of the first conveying path 11 and the second conveying path 12 (No in Act 703), in Act 706, the CPU 200 determines whether the sheet P other than the sheet P that causes the jam is present in the conveying path. If the sheet P other than the sheet P that causes the jam is absent in the conveying path (Yes in Act 706), in Act 704, the CPU 200 stops the operation. In Act 705, the CPU 200 displays, for example, an error code on the display section 211 and ends the processing.

If the sheet P other than the sheet P that causes the jam is present in the conveying path (No in Act 706), in Act 707, the CPU 200 continues the processing of the sheet P other than the sheet P that causes the jam. In Act 708, the CPU 200 determines whether discharge of all the sheets P is completed. If the discharge of all the sheets P is not completed (No in Act 708), the CPU 200 repeats the processing in Act 708. If the discharge of all the sheets P is completed (Yes in Act 708), in Act 705, the CPU 200 displays, for example, an error code on the display 211 and ends the processing.

Figure 19:
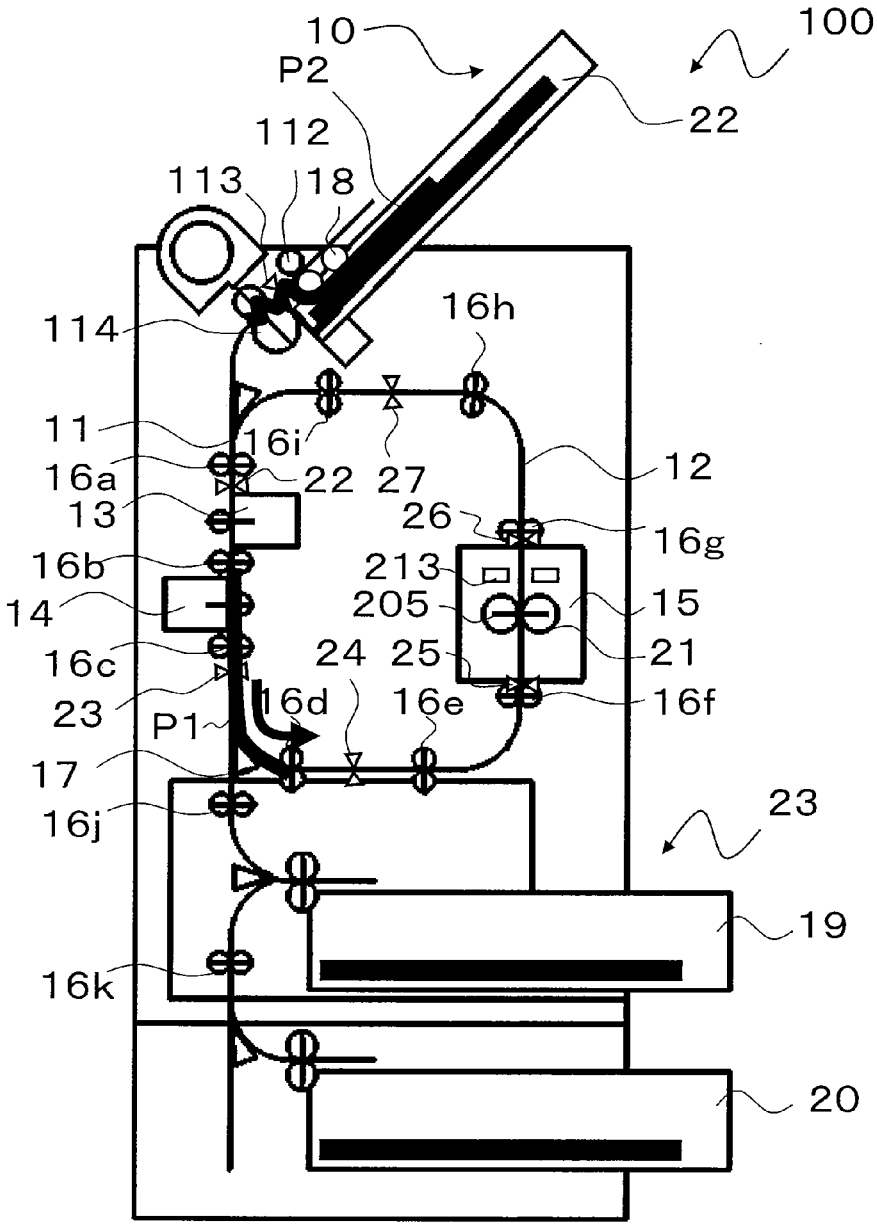
FIG. 19 is a diagram of a state in which a jam occurs in a paper feeding section in the second embodiment.

FIG. 19 is a diagram of a state in which the preceding first sheet P1 is conveyed from the first conveying path 11 to the second conveying path 12 and the second sheet P2 causes a jam in the paper feeding section 10. This is a state in which it is determined No in Act 706 of FIG. 18.

In this state, since the leading end of the following second sheet P2 is present upstream of the merging point of the first conveying path 11 and the second conveying path 12, it is possible to convey and process the first sheet P1. Therefore, the conveyance and the processing of the first sheet P1 are continued. The first sheet P1 for which the processing ends is discharged to the paper discharge section 23. The first sheet P1 is subjected to, for example, the reading processing for reading an image in the first reading section 13 and the second reading section 14, the erasing processing in the erasing section 15, the reading processing for an image in the first reading section 13 and the second reading section 14, and the sorting processing for determining whether the first sheet P1 is reusable. The first sheet P1 is discharged to the paper discharge section 23.

The leading end of the second sheet P2 causes a sheet jam in the paper feeding section 10 and the trailing end of the second sheet P2 is present on the paper feeding tray 22. Therefore, it is possible to perform jam treatment without opening the cover of the erasing apparatus 100.

Usually, when a sheet jam occurs in a erasing apparatus, the erasing apparatus stops operation and a sheet that does not cause a jam also remains in a conveying path. At this point, work for opening the cover and remove the sheet that does not cause a jam from the conveying path is necessary. However, since the erasing apparatus 100 according to this embodiment explained above continues the processing for the sheet that does not cause a jam, it is possible to improve operability. If the sheet P1 being subjected to the erasing processing causes a jam in the erasing section 116 and the sheet P2 remains in the erasing section 116, it is likely that the sheets P1 and P2 are burned. However, by performing the conveyance control explained above, it is possible to safely stop the erasing apparatus 100.

Third Embodiment

Figure 20:
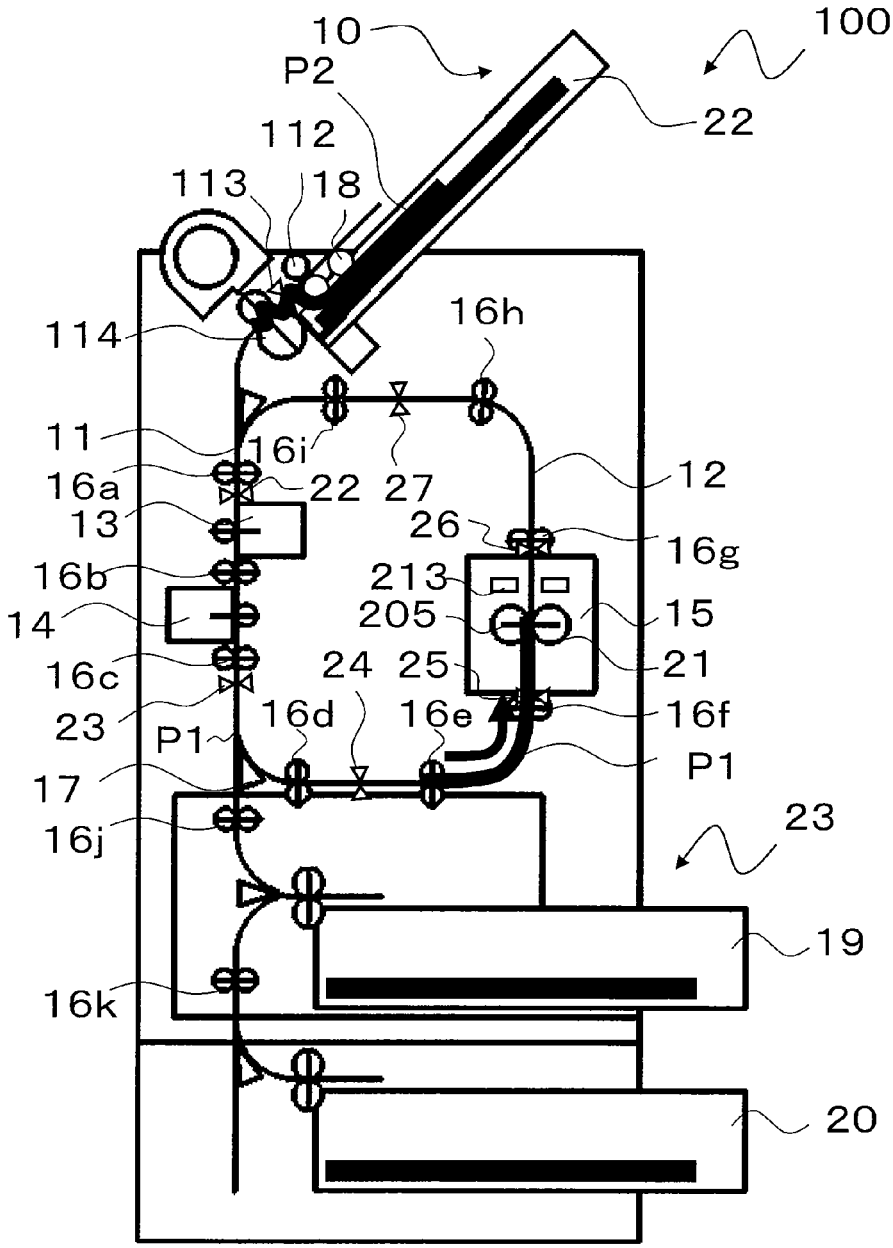
FIG. 20 is a diagram of a state in which a jam occurs in a paper feeding section and a preceding sheet is conveyed in a third embodiment.
Figure 21:
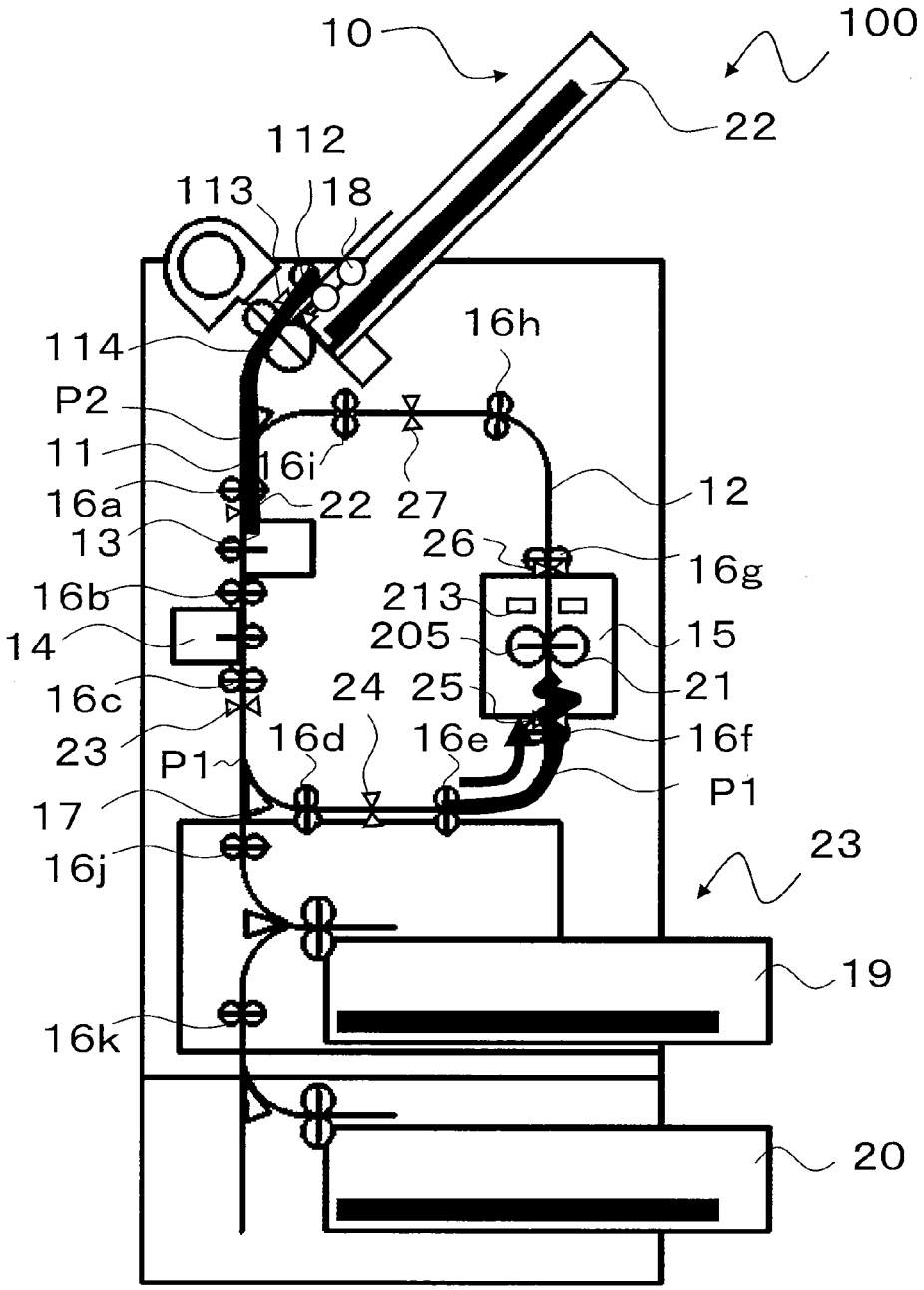
FIG. 21 is a diagram of a state in which a jam occurs in a erasing section and the following sheet is conveyed in the third embodiment.
Figure 22:
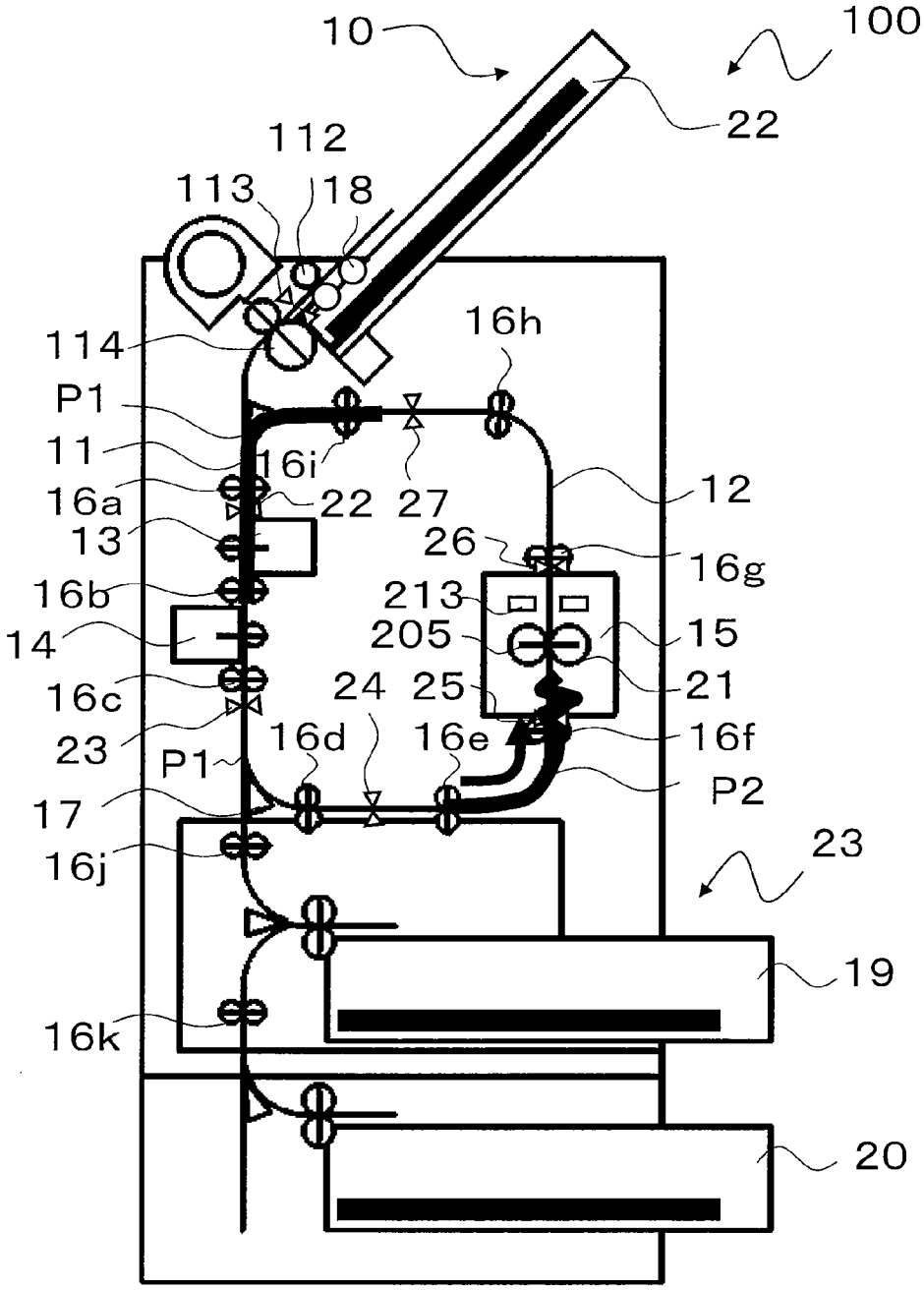
FIG. 22 is a diagram of a state in which a jam occurs in the erasing section and a preceding sheet is conveyed in the third embodiment.

A erasing apparatus according to a third embodiment shown in FIGS. 20 to 22 discharges, when a sheet jam occurs, if a sheet that does not cause a jam is present in a conveying path, the sheet that does not cause a jam to a paper discharge section. If the erasing apparatus has to be stopped in a state in which a sheet is present in a erasing section, the erasing apparatus moves the sheet in the erasing section from the erasing section.

FIG. 20 is a diagram of a state in which the second sheet P2 causes a jam in the paper feeding section 10 and the conveyance of the preceding first sheet P1 is stopped in the erasing section 15. At this point, since the leading end of the following second sheet P2 is present upstream of the merging point of the first conveying path 11 and the second conveying path 12, it is possible to convey and process the first sheet P1. Therefore, the conveyance and the processing of the first sheet P1 are continued. The first sheet P1 for which the processing ends is discharged to the paper discharge section 23.

The leading end of the second sheet P2 causes a jam in the paper feeding section 10 and the trailing end of the second sheet P2 is present on the paper feeding tray 22. Therefore, it is possible to perform jam treatment without opening the cover of the erasing apparatus 100.

Conveyance control performed when the first sheet P1 conveyed earlier causes a jam in the erasing section 15 is explained. FIG. 21 is a diagram of a state in which the first sheet P1 causes a jam in the erasing section 15 and the conveyance of the following second sheet P2 is stopped in the first conveying path 11. In this state, if the second sheet P2 is to be subjected to only reading processing or sorting processing, the reading processing or the sorting processing is continued. Thereafter, the second sheet P2 is discharged to the paper discharge section 23. If the second sheet P2 is to be subjected to processing other than the reading processing or the sorting processing, the second sheet P2 is discharged to the paper discharge section 23 without being subjected to the processing.

After the second sheet P2 is discharged, the conveying rollers 16*d*, 16*e*, and 16*f* are reversely rotated to convey the first sheet P1 that causes a jam in a direction opposite to a conveying direction. The path changing section 17 is controlled to convey the first sheet P1 from the second conveying path 12 to the first conveying path 11 and temporarily stop the first sheet P1. The conveying rollers 16*a*, 16*b*, 16*c*, and 16*j* are normally rotated to convey the first sheet P1 conveyed to the first conveying path 11 in the conveying direction. The path changing section 17 is controlled to discharge the first sheet P1 to the paper discharge section 23.

The order of conveying the first sheets P1 and P2 is not limited to the above. Depending on the position of the second sheet P2 in the first conveying path 11, after the first sheet P1 is discharged to the paper discharge section 23 first, the second sheet P2 may be discharged to the paper discharge section 23.

Conveyance control performed when the second sheet P2, which is the following sheet, causes a jam in the erasing section 15 is explained. FIG. 22 is a diagram of a state in which the second sheet P2 causes a jam in the erasing section 15 and the conveyance of the preceding first sheet P1 is stopped in the first conveying path 11. In this state, since the first sheet P1 is already subjected to erasing processing by the erasing section 15, the first sheet P1 is directly subjected to the reading processing or the sorting processing, which is the following processing, and discharged to the paper discharge section 23.

After the first sheet P1 is discharged, the conveying rollers 16*d*, 16*e*, and 16*f* are reversely rotated to convey the second sheet P2 that causes a jam in the direction opposite to the conveying direction. The path changing section 17 is controlled to convey the second sheet P2 from the second conveying path 12 to the first conveying path 11 and temporarily stop the second sheet P2. The conveying rollers 16*a*, 16*b*, 16*c*, and 16*j* are normally rotated to convey the second sheet P2 conveyed to the first conveying path 11 in the conveying direction. The path changing section 17 is controlled to discharge the second sheet P2 to the paper discharge section 23.

The order of conveying the second sheets P1 and P2 is not limited to the above. Depending on the position of the first sheet P1, after the second sheet P2 is discharged to the paper discharge section 23 first, the first sheet P1 may be discharged to the paper discharge section 23.

If the sheet P1 being subjected to the erasing processing causes a jam in the erasing section 116 and the sheet P2 remains in the erasing section 116, it is likely that the sheets P1 and P2 are burned. However, by performing the conveyance control explained above, it is possible to safely stop the erasing apparatus 100.

According to this embodiment, since the erasing apparatus 100 continues the processing for the sheet that does not cause a jam, it is possible to improve operability. When a sheet jam occurs, even if the sheet P is present in the erasing section 15, the sheet P that causes the jam is conveyed to the first conveying path 11 in the direction opposite to the conveying direction and thereafter conveyed in the conveying direction. The path changing section 17 is controlled to discharge the sheet P to the paper discharge section 23. Consequently, it is possible to safely stop the erasing apparatus 100.

While certain embodiments have been described, these embodiments have been presented by way of example only, and are not intended to limit the scope of the invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. An erasing apparatus comprising:

a paper feeding section configured to feed a recording medium on which an erasable image is recorded to a conveying path;

a reading section arranged on the conveying path and configured to read an image on the recording medium;

a paper discharge section configured to store the recording medium;

a conveying section configured to convey the recording medium along the conveying path, the conveying path including a first conveying path from the feeding section toward the paper discharge section and a second conveying path branching from the first conveying path downstream of the reading section in a paper conveying direction and merging with the first conveying path at a meeting point between the paper feeding section and the reading section;

an erasing section disposed on the second conveying path and configured to erase a color of the erasable image on the recording medium;

a first conveying roller located along the second conveying path from the erasing section toward upstream in a conveying direction of the recording medium;

a first sensor positioned to detect a jam in a first portion of the second conveying path within the erasing section, the first sensor being located along the second conveying path from the first conveying roller toward downstream in the conveying direction and being located along the second conveying path from the erasing section toward upstream in the conveying direction;

a second sensor positioned to detect a jam in a second portion of the second conveying path outside the erasing section; and a control section configured to control the conveying section to convey the recording medium along the second conveying path based on whether a detected jam is detected in the first portion or in the second portion.

2. The apparatus according to claim 1, wherein, if the detected jam is detected in the first portion, the control section controls the conveying section to convey the recording medium from the erasing section to a position outside of the erasing section.

3. The apparatus according to claim 2, wherein the control section further controls a conveying direction in which the conveying section conveys the recording medium to the position outside of the erasing section depending on whether the detected jam is detected in the first portion or in the second portion.

4. The apparatus according to claim 3, wherein, if the recording medium present in the erasing section is unconveyable in a direction downstream of the erasing section due to the detected jam, the control section controls the conveying section to convey the recording medium in a direction upstream of the erasing section.

5. The apparatus according to claim 3, wherein, if the recording medium present in the erasing section is conveyable in a direction downstream of the erasing section, the control section controls the conveying section to convey the recording medium in the downstream direction.

6. The apparatus according to claim 5, further comprising a paper discharge section configured to receive the recording medium, wherein the control section controls the conveying section to discharge the recording medium to the paper discharge section.

7. The apparatus according to claim 1, wherein, if the recording medium present in the conveying path is conveyable in a direction downstream of the erasing section, the control section continues a processing of the recording medium.

8. The apparatus according to claim 7, wherein, after the paper feeding section feeds a first recording medium to the first conveying path, if at least one of the plurality of sensors detects a jam of a second recording medium in the paper feeding section, the control section continues a processing of the first recording medium.

9. The apparatus according to claim 1, further comprising:

a display section configured to display occurrence of the detected jam, wherein the control section controls the display section to display the occurrence of the jam on the display section after controlling the conveying section to convey the recording medium to the paper discharge section.

10. The apparatus according to claim 1, wherein the erasing section includes a heating source and a shutter configured to cover and uncover the heating source relative to the second conveying path.

11. The apparatus according to claim 10, wherein the shutter is arranged on both sides of the first portion of the conveying section.

12. The apparatus according to claim 10, wherein the shutter closes when an erasing processing ends and when a jam is detected.

13. The apparatus according to claim 1 further comprising:

a second conveying roller located along the second conveying path downstream from the erasing section in the conveying direction of the recording medium, wherein the second sensor is located along the second conveying path upstream from the second conveying roller in the conveying direction and located downstream along the second conveying path from the erasing section in the conveying direction.

14. A conveyance control method for a recording medium by an erasing apparatus including: a reading section arranged on a first conveying path and configured to read an image on the recording medium; an erasing section arranged on a second conveying path and configured to erase an image on the recording medium; a first conveying roller located along the second conveying path upstream from the erasing section in a conveying direction of the recording medium; a first sensor positioned to detect a jam, the first sensor being located along the second conveying path downstream from the first conveying roller in the conveying direction and located along the second conveying path upstream from the erasing section in the conveying direction; a second sensor positioned to detect a jam; and a conveying section configured to convey the recording medium, the method comprising:

reading, with the reading section, the image on the recording medium;

conveying, with the conveying section, the recording medium from the first conveying path to the second conveying path, wherein the second conveying path branches from the first conveying path downstream of the reading section in a paper conveying direction of the first conveying path and merges with the first conveying path upstream of the reading section in the paper conveying direction of the first conveying path;

erasing, with the erasing section including a heating source, the image on the recording medium;

detecting occurrence of a jam of the recording medium in the second conveying path, wherein the jam is determined to be in a first portion of the second conveying path within the erasing section if the jam is detected by the first sensor and the jam is determined to be in a second portion of the second conveying path outside of the erasing section if the jam is detected by the second sensor; and performing, when the jam of the recording medium occurs, control to convey the recording medium along the second conveying path based on whether a detected jam is determined to be in the first portion or in the second portion.

15. The method according to claim 14, further comprising:

determining that the detected jam is located in the first portion, wherein controlling conveyance of the recording medium along the second conveying path comprises conveying the recording medium from the erasing section to a position outside of the erasing section.

16. The method according to claim 15, further comprising controlling a conveying direction in which the conveying section conveys the recording medium to the position outside of the erasing section depending on whether the detected jam is detected in the first portion or in the second portion.

17. The method according to claim 16, further comprising:

determining that the recording medium is unconveyable in a direction downstream of the erasing section due to the detected jam, wherein controlling a conveying direction comprises controlling conveyance of the recording medium in a direction upstream of the erasing section.

18. The method according to claim 16, further comprising;

determining that the recording medium is conveyable in a direction downstream of the erasing section, wherein controlling a conveying direction comprises controlling conveyance of the recording medium in the direction downstream of the erasing section.

19. The method according to claim 18, further comprising:

conveying the recording medium to a paper discharge section configured to receive the recording medium; and discharging the recording medium to the paper discharge section.

20. The method according to claim 14, further comprising:

conveying the recording medium to a paper discharge section configured to store the recording medium; and displaying, on a display section, occurrence of the detected jam after conveying the recording medium to the paper discharge section.

21. The method according to claim 14, further comprising covering the heating source of the erasing section with a shutter when the jam is detected in the conveying path.

* * * * *